US006768479B2

(12) United States Patent
Nakamura

(10) Patent No.: US 6,768,479 B2
(45) Date of Patent: Jul. 27, 2004

(54) METHOD FOR DRIVING A PLASMA DISPLAY PANEL

(75) Inventor: Hideto Nakamura, Yamanashi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 226 days.

(21) Appl. No.: 10/171,546

(22) Filed: Jun. 17, 2002

(65) Prior Publication Data

US 2003/0011542 A1 Jan. 16, 2003

(30) Foreign Application Priority Data

Jun. 27, 2001 (JP) ..... 2001-194799

(51) Int. Cl.[7] ..... G09G 3/28

(52) U.S. Cl. ..... 345/60; 345/61; 345/68; 345/55; 345/74.1; 315/111.21; 315/168.1; 315/169.2; 315/169.3; 315/169.4

(58) Field of Search ..... 345/55, 60, 61, 345/62, 63, 68, 74.1; 315/111.21, 169.1, 169.2, 169.3, 169.4

(56) References Cited

U.S. PATENT DOCUMENTS 6,160,529 A * 12/2000 Asao et al. ..... 345/60
2001/0038364 A1 * 11/2001 Ito et al. ..... 345/55

* cited by examiner

*Primary Examiner*—Bipin Shalwala
*Assistant Examiner*—Vincent E. Kovalick
(74) *Attorney, Agent, or Firm*—Sughrue Mion, PLLC

(57) ABSTRACT

A driving method of a plasma display panel for achieving a high-quality image display by preventing an erroneous discharge light emission between row electrodes during a light emission sustaining step. In each subfield, a pixel data writing step and the light emission sustaining step are performed, and an address pulse, having the same polarity as the polarity of a sustain pulse first applied during the light emission sustaining step, is applied to the respective column electrodes concurrently with the first-applied sustain pulse.

6 Claims, 18 Drawing Sheets

FIG. 9

| LC | SF1 | SF2 | SF3 | SF4 | SF5 | SF6 | SF7 | SF8 | SF9 | SF10 | SF11 | SF12 | SF13 | SF14 |
|---|---|---|---|---|---|---|---|---|---|---|---|---|---|---|
| 1ST MODE | 4 | 12 | 20 | 32 | 40 | 52 | 64 | 76 | 88 | 100 | 112 | 128 | 140 | 156 |
| 2ND MODE | 3 | 9 | 15 | 24 | 30 | 39 | 48 | 57 | 66 | 75 | 84 | 96 | 105 | 117 |

FIG. 12

SELECTIVE ERASING

LIGHT EMITTING LUMINANCE

| GRADATION LEVEL | SF 1 | SF 2 | SF 3 | SF 4 | SF 5 | SF 6 | SF 7 | SF 8 | SF 9 | SF 10 | SF 11 | SF 12 | SF 13 | SF 14 | 1ST MODE | 2ND MODE |
|---|---|---|---|---|---|---|---|---|---|---|---|---|---|---|---|---|
| 1 | ● | | | | | | | | | | | | | | 0 | 0 |
| 2 | ○ | ● | | | | | | | | | | | | | 4 | 3 |
| 3 | ○ | ○ | ● | | | | | | | | | | | | 16 | 12 |
| 4 | ○ | ○ | ○ | ● | | | | | | | | | | | 36 | 27 |
| 5 | ○ | ○ | ○ | ○ | ● | | | | | | | | | | 68 | 51 |
| 6 | ○ | ○ | ○ | ○ | ○ | ● | | | | | | | | | 108 | 81 |
| 7 | ○ | ○ | ○ | ○ | ○ | ○ | ● | | | | | | | | 160 | 120 |
| 8 | ○ | ○ | ○ | ○ | ○ | ○ | ○ | ● | | | | | | | 224 | 168 |
| 9 | ○ | ○ | ○ | ○ | ○ | ○ | ○ | ○ | ● | | | | | | 300 | 225 |
| 10 | ○ | ○ | ○ | ○ | ○ | ○ | ○ | ○ | ○ | ● | | | | | 388 | 291 |
| 11 | ○ | ○ | ○ | ○ | ○ | ○ | ○ | ○ | ○ | ○ | ● | | | | 488 | 366 |
| 12 | ○ | ○ | ○ | ○ | ○ | ○ | ○ | ○ | ○ | ○ | ○ | ● | | | 600 | 450 |
| 13 | ○ | ○ | ○ | ○ | ○ | ○ | ○ | ○ | ○ | ○ | ○ | ○ | ● | | 728 | 546 |
| 14 | ○ | ○ | ○ | ○ | ○ | ○ | ○ | ○ | ○ | ○ | ○ | ○ | ○ | ● | 868 | 651 |
| 15 | ○ | ○ | ○ | ○ | ○ | ○ | ○ | ○ | ○ | ○ | ○ | ○ | ○ | ○ | 1024 | 768 |

BLACK CIRCLE : SELECTIVE ERASING DISCHARGE
WHITE CIRCLE : LIGHT EMISSION

FIG. 13

SELECTIVE ERASING

| Ds | HD 1 | 2 | 3 | 4 | 5 | 6 | 7 | 8 | 9 | 10 | 11 | 12 | 13 | 14 | LIGHT EMISSION DRIVING PATTERN IN ONE FIELD SF 1 | SF 2 | SF 3 | SF 4 | SF 5 | SF 6 | SF 7 | SF 8 | SF 9 | SF 10 | SF 11 | SF 12 | SF 13 | SF 14 | LIGHT EMITTING LUMINANCE |
|---|---|---|---|---|---|---|---|---|---|---|---|---|---|---|---|---|---|---|---|---|---|---|---|---|---|---|---|---|---|
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 256 |

BLACK CIRCLE : SELECTIVE ERASING DISCHARGE
WHITE CIRCLE : LIGHT EMISSION

METHOD FOR DRIVING A PLASMA DISPLAY PANEL

BACKGROUND OF THE INVENTION

1. Field of the Invention

The present invention relates to a driving method for driving a plasma display panel of a matrix display type.

2. Description of the Related Background Art

In recent years, in association with enlargement of a display apparatus, a thin-type display apparatus has been required and various thin-type display apparatuses have been put into practical use. As one of the thin-type display apparatuses, attention is paid to a display apparatus using an AC (alternating discharge) type PDP (plasma display panel).

FIG. 1 is a diagram schematically showing an arrangement of a plasma display apparatus including a plasma display panel and its driving device.

As shown in FIG. 1, a PDP 10 is provided with m column electrodes $D_1$ through $D_m$ serving as data electrodes, and n row electrodes $X_1$ through $X_n$ and n row electrodes $Y_1$ through $Y_n$ aligned to intersect with the respective column electrodes. Pairs of one row electrode $X_i$ ($1 \leqq i \leqq n$) from the electrodes $X_1$ through $X_n$ and one row electrode $Y_i$ ($1 \leqq i \leqq n$) from the row electrodes $Y_1$ through $Y_n$ are responsible for respective display lines of the PDP. The electrodes $X_1$ through $X_n$ and the row electrodes $Y_1$ through $Y_n$ form respective display lines of the PDP so that one row electrode $X_i$ ($1 \leqq i \leqq n$) and one row electrode $Y_i$ ($1 \leqq i \leqq n$) are in pairs for one display line. It is arranged in such a manner that the column electrode D and the row electrodes X and Y are placed to oppose each other with a discharge space filled with a discharge gas in between, and that a discharge cell corresponding to one pixel is formed at each intersection portion of the row electrode pairs and the column electrodes having the discharge space.

Herein, because each discharge cell emits light by exploiting a discharge phenomenon, it can take only two conditions: "a light emitting condition" and "a non-luminous condition." In other words, each can display only two levels of luminance: the lowest luminance (non-luminous condition) and the highest luminance (light emitting condition).

A driving device 100 performs a gradation driving using the subfield method with respect to the PDP 10 arranged as above in order to achieve a half-tone luminance display corresponding to an input video signal. According to the subfield method, an input video signal is converted into, for example, 4-bit pixel data corresponding to each pixel, and as shown in FIG. 2, a display period of one field is divided into four subfields SF1 through SF4 to respectively correspond to the bit orders of the pixel data. As shown in FIG. 2, each subfield is given with the number of light emissions (or a light emitting period) corresponding to their respective weights.

FIG. 3 shows various kinds of driving pulses that the driving device 100 applies to the row electrode pairs and the column electrodes of the PDP 10 within each subfield shown in FIG. 2 and the application timings.

As shown in FIG. 3, the driving device 100 initially applies a reset pulse $PR_x$ of a positive polarity to the row electrodes $X_1$ through $X_n$ and a reset pulse $RP_y$ of a negative polarity to the row electrodes $Y_1$ through $Y_n$. When these reset pulses $PR_x$ and $RP_y$ are applied, a reset discharge takes place in all the discharge cells of the PDP 10, whereby wall charges of a predetermined quantity are formed uniformly in each discharge cell. Consequently, all the discharge cells of the PDP 10 are initialized to be in a "light emitting cell" condition (collective reset step Rc).

Then, the driving device 100 separates the bit orders in the 4-bit pixel data into the subfields SF1 through SF4, respectively, and generates a pixel data pulse having a pulse voltage corresponding to the logical level of each bit. For example, in a pixel data writing step Wc in the subfield SF1, the driving device 100 generates a pixel data pulse having a pulse voltage corresponding to the logical level of the first bit of the pixel data. At this point, the driving device 100 generates a pixel data pulse having a pulse voltage at a high voltage when the logical level of the first bit is "1", and generates a pixel data pulse having a pulse voltage at a low voltage (0 V) when the logical level of the first bit is "0". Then, as shown in FIG. 3, the driving device 100 successively applies the pixel data pulses thus generated to the column electrodes $D_1$ through $D_m$ as one display line of pixel data pulse groups $DP_1$ through $DP_n$ for each of the first through n-th display lines. Further, the driving device 100 generates a scanning pulse SP of a negative polarity as shown in FIG. 3 in sync with the application timing of each pixel data pulse group DP, and successively applies the same to the row electrodes $Y_1$ through $Y_n$. At this point, a discharge (selective erasing discharge) takes place only in the discharge cells at the intersections of the display lines applied with the scanning pulse SP and the "columns" applied with the pixel data pulse of a high voltage, so that the wall charges formed within these discharge cells are lost. Consequently, the discharge cells initialized to be in the "light emitting cell" condition in the collective reset step Rc are changed to be in a "non-luminous cell" condition. On the other hand, the selective erasing discharge does not take place in the discharge cells applied with the scanning pulse SP and a pixel data pulse of a low voltage, and therefore, these discharge cells are sustained in the condition initialized in the collective reset step Rc, that is, the "light emitting cell" condition. In other words, each discharge cell of the PDP 10 is set to either the "light emitting cell" or "non-luminous cell" condition in response to the pixel data corresponding to the input video signal (pixel data writing step Wc).

Then, the driving device 100 repetitively applies sustain pulses $IP_x$ and $IP_y$ as shown in FIG. 3 to the row electrodes $X_1$ through $X_n$ and the row electrodes $Y_1$ through $Y_n$, respectively, in turn. The number of applications (or a period the application is continued) of the sustain pulses $IP_x$ and $IP_y$ applied during a light emission sustaining step Ic in each of the subfields SF1 through SF4 is, as set forth in FIG. 2, as follows given that "1" is the number of applications during the light emission sustaining step Ic in the subfield SF1:

| | |
|---|---|
| SF1: | 1 |
| SF2: | 2 |
| SF3: | 4 |
| SF4: | 8. |

Herein, only the discharge cells holding residual wall charges within their discharge spaces, that is, the "light emitting cells", discharge (sustained discharge) each time these sustain pulses $IP_x$ and $IP_y$ are applied. In other words, only the discharge cells in which the selective erasing discharge did not take place during the pixel data writing step Wc repeatedly emit light with the sustained discharge as many times as assigned to each subfield as described above, thereby sustaining the light emitting condition (light emission sustaining step Ic).

Finally, the driving device 100 applies an erasing pulse EP as shown in FIG. 3 to the row electrodes $Y_1$ through $Y_n$ concurrently. When the erasing pulse EP is applied, an erasing discharge takes place in all the discharge cells of the PDP 10, and the residual wall charges in the discharge cells are all lost (erasing step E).

A series of operations composed of the collective reset step Rc, the pixel data writing step Wc, the light emission sustaining step Ic, and the erasing step E are performed in each of the subfields SF1 through SF4 shown in FIG. 2. According to this driving, light emissions with the sustained discharge are repeated a specified number of times corresponding to the luminance level of the input video signal throughout the display period of one field, and one can perceive the half-tone luminance corresponding to the number of light emission by sight. At this point, according to the gray scale driving based on the four subfields SF1 through SF4 as shown in FIG. 2, it is possible to display the half-tone luminance "0" through "15" in 16 levels (16-level of gray scale).

With a display apparatus using the subfield method described as above, a discharge readily occurs between the column electrodes and the row electrodes when an accumulative light emitting time of the PDP becomes longer. If the sustain pulses are applied to the column electrodes during the light emission sustaining step under these conditions, a discharge occurs between the column electrodes and the row electrodes in the discharge cells set in the non-luminous condition, which may possibly result in an erroneous discharge light emission between the row electrodes.

SUMMARY OF THE INVENTION

It is therefore an object of the present invention to provide a driving method of a plasma display panel for achieving a high-quality image display by preventing an erroneous discharge light emission between the row electrodes during the light emission sustaining step.

According to the invention, there is provided a method for driving a plasma display panel including a plurality of row electrode pairs each of which has a capacitive load between the row electrodes of each pair and a plurality of column electrodes arranged to intersect with the row electrode pairs to form a discharge cell at each intersection portion, to display an image with gradations in accordance with a video signal, the method comprising the steps of: forming a plurality of subfields into which a display period of one field in the video signal are divided, in each of the subfields, executing: a pixel data writing step for generating pixel data indicating one of a light emitting cell and a non-light emitting cell for each discharge cell of the plasma display panel in accordance with the video signal, for applying a scanning pulse to one row electrode in each pair of the plurality of row electrode pairs successively and for applying a pixel data pulse corresponding to the pixel data to each of the plurality of column electrodes in synchronism with the scanning pulse, so that each discharge cell becomes one of a light emitting cell condition and a non-light emitting cell condition corresponding to the pixel data; and a light emission sustaining step for applying a sustain pulse to row electrodes in each pair of the plurality of row electrode pairs alternately by the number of times corresponding to weights assigned to each of the subfields, so that only discharge cells which have become the light emitting cell condition in the pixel data writing step sustain discharge, and applying an address pulse to each of the column electrodes concurrently with a first sustain pulses which is a sustain pulse first applied during the light emission sustaining step, the address pulse and the first sustain pulse having a same polarity.

According to the invention, there is provided a method for driving a plasma display panel including a plurality of row electrode pairs each of which has a capacitive load between the row electrodes of each pair and a plurality of column electrodes arranged to intersect with the row electrode pairs to form a discharge cell at each intersection portion, to display an image with gradations in accordance with a video signal, the method comprising the steps of: forming a plurality of subfields into which a display period of one field in the video signal are divided, in each of the subfields, executing: a pixel data writing step for generating pixel data indicating one of a light emitting cell and a non-light emitting cell for each discharge cell of the plasma display panel in accordance with the video signal, for applying a scanning pulse to one row electrode in each pair of the plurality of row electrode pairs successively and for applying a pixel data pulse corresponding to the pixel data to each of the plurality of column electrodes in synchronism with the scanning pulse, so that each discharge cell becomes one of a light emitting cell condition and a non-light emitting cell condition corresponding to the pixel data; and a light emission sustaining step for applying a sustain pulse to row electrodes in each pair of the plurality of row electrode pairs alternately by the number of times corresponding to weights assigned to each of the subfields, so that only discharge cells which have become the light emitting cell condition in the pixel data writing step sustain discharge, and applying a discharge control pulse to one row electrode in each pair of the plurality of row electrode pairs concurrently with a first sustain pulse, which is a sustain pulse applied first to the other row electrode in each pair of the plurality of row electrode pairs during the light emission sustaining step, the discharge control pulse having a same polarity as the first sustain pulse and having a pulse width narrower than the pulse width of the first sustain pulse.

BRIEF DESCRIPTION OF THE DRAWINGS

FIG. 9 is a diagram showing a correspondence between luminance modes and a ratio of the number of light emissions during a light emission sustaining step in each subfield;

FIG. 12 is a diagram showing one example of a light emission driving pattern performed based on the light emission driving format of FIG. 5;

FIG. 13 is a diagram showing all the light emission driving patterns performed based on the light emission driving format of FIG. 5 and one example of a conversion table used in a second data converting circuit 34 when the light emission driving is performed;

DETAILED DESCRIPTION OF THE PREFERRED EMBODIMENTS

The following description will describe embodiments of the present invention in detail with reference to the drawings.

Figure 4:
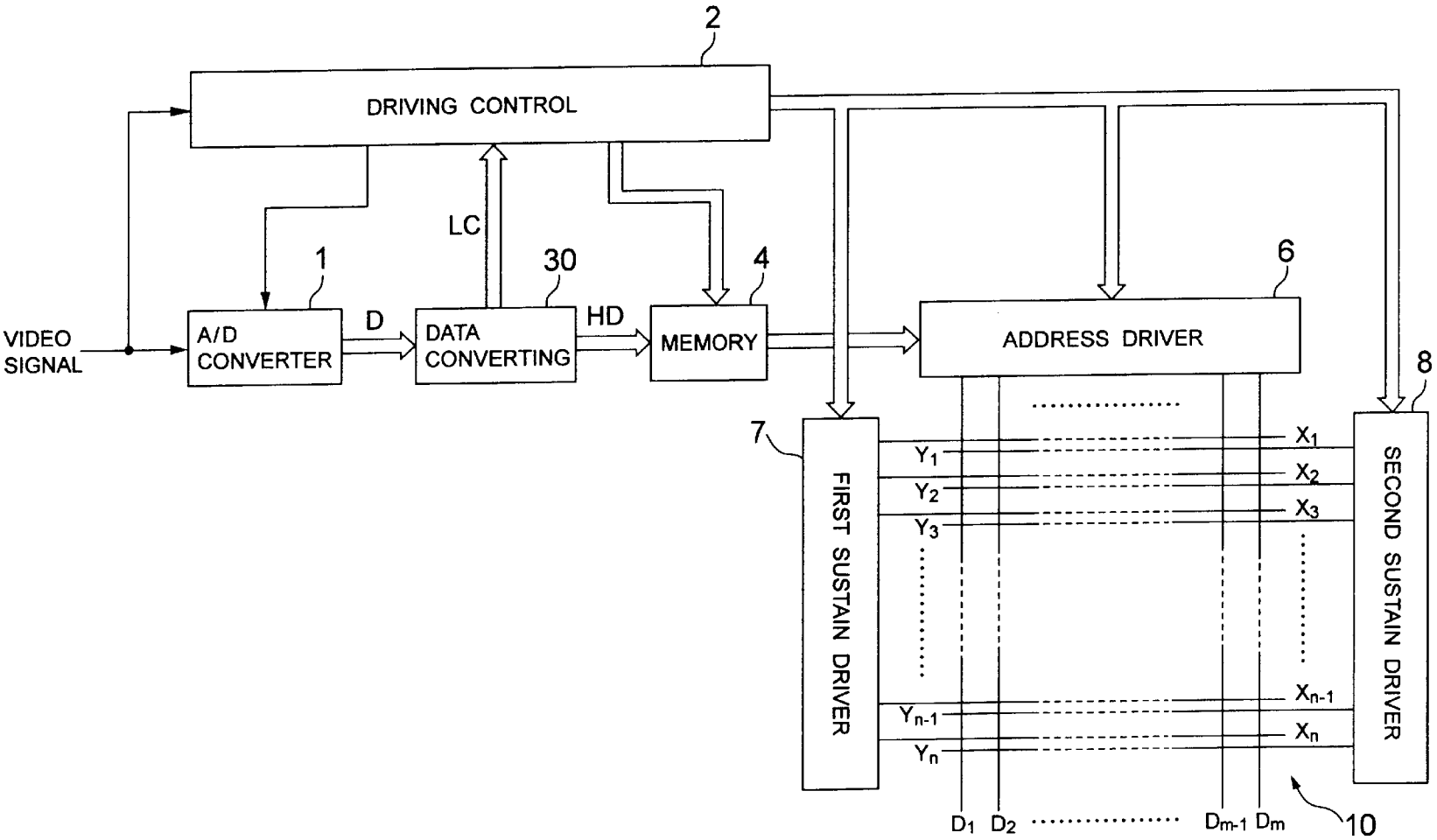
FIG. 4 is a diagram schematically showing an arrangement of a display apparatus using a driving method of the present invention.

FIG. 4 is a view schematically showing an arrangement of a display apparatus using a driving method according to the present invention.

As shown in FIG. 4, the display apparatus is provided with an analog-to-digital converter 1, a driving control circuit 2, a data converting circuit 30, a memory 4, a PDP (plasma display panel) 10, an address driver 6, and first and second sustaining drivers 7 and 8.

The analog-to-digital converter 1 performs a sampling of an analog input video signal in response to a clock signal supplied from the driving control circuit 2, converts the input video signal into, for example, 8-bit pixel data (input pixel data) D for each pixel, and supplies the same to the data converting circuit 30.

The driving control circuit 2 generates the clock signal for the analog-to-digital converter 1 and a read/write signal for the memory 4 in sync with horizontal and vertical synchronizing signals in the input video signal. Further, the driving control circuit 2 generates various kinds of timing signals for controlling the driving of the address driver 6, the first sustaining driver 7, and the second sustaining driver 8 individually in sync with the horizontal and vertical synchronizing signals.

The data converting circuit 30 converts the 8-bit pixel data D into 14-bit converted pixel data (display pixel data) HD, and supplies the same to the memory 4. The converting operation of the data converting circuit 30 will be described below.

The memory 4 successively writes the converted pixel data HD in accordance with the write signal supplied from the driving control circuit 2. When the writing of one screen (n rows by m columns) ends by this writing operation, the memory 4 reads out one screen of the converted pixel data $HD_{11}$ through $HD_{nm}$ by dividing the same per bit order, and successively supplies one row of the converted pixel data to the address driver 6 row by row.

The address driver 6 generates m pixel data pulses, having voltages corresponding to the respective logical levels of one row of the converted pixel data bits read out from the memory 4, in response to the timing signal supplied from the driving control circuit 2, and applies the same to the column electrodes $D_1$ through $D_m$ of the PDP 10.

PDP 10 is provided with the column electrodes $D_1$ through $D_m$ serving as address electrodes and row electrodes $X_1$ through $X_n$ and row electrodes $Y_1$ through $Y_n$ aligned to intersect at right angles with the column electrodes $D_1$ through $D_m$. In the PDP 10, a pair of row electrode X and a row electrode Y form a row electrode corresponding to one row. In other words, a row electrode pair in the first row of the PDP 10 is composed of the row electrode $X_1$ and the row electrode $Y_1$, and a row electrode pair in the n'th row is composed of the row electrode $X_n$ and the row electrode $Y_n$. The row electrode pairs and the column electrodes are coated with a dielectric layer with respect to a discharge space, and they are structured in such a manner that a discharge cell serving as a pixel is formed at each intersection of the row electrode pairs and column electrodes.

Each of the first sustaining driver 7 and the second sustaining driver 8 generates various kinds of driving pulses described below in response to the timing signal supplied from the driving control circuit 2, and applies these driving pulses to the row electrodes $X_1$ through $X_n$ and $Y_1$ through $Y_n$ of the PDP 10.

Figure 5:
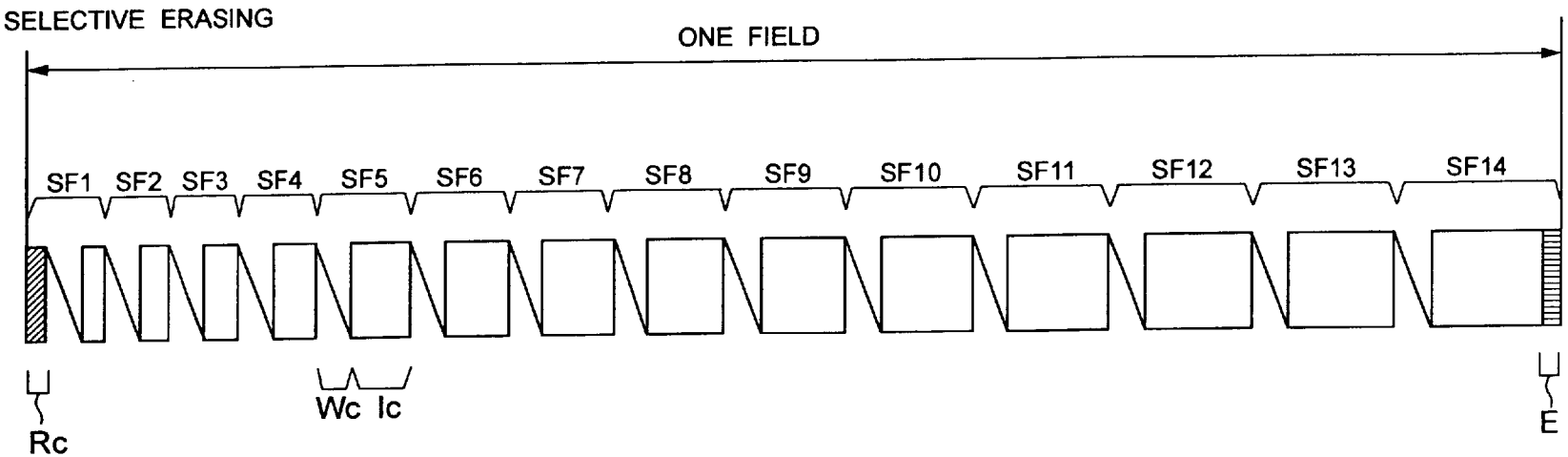
FIG. 5 is a diagram showing a light emission driving format when a selective erasing address method is adopted.

According to this display apparatus, the PDP 10 is driven in response to the timing signals supplied from the driving control circuit 2 by dividing a display period of one field into 14 subfields SF1 through SF14 as shown in FIG. 5.

Figure 6:
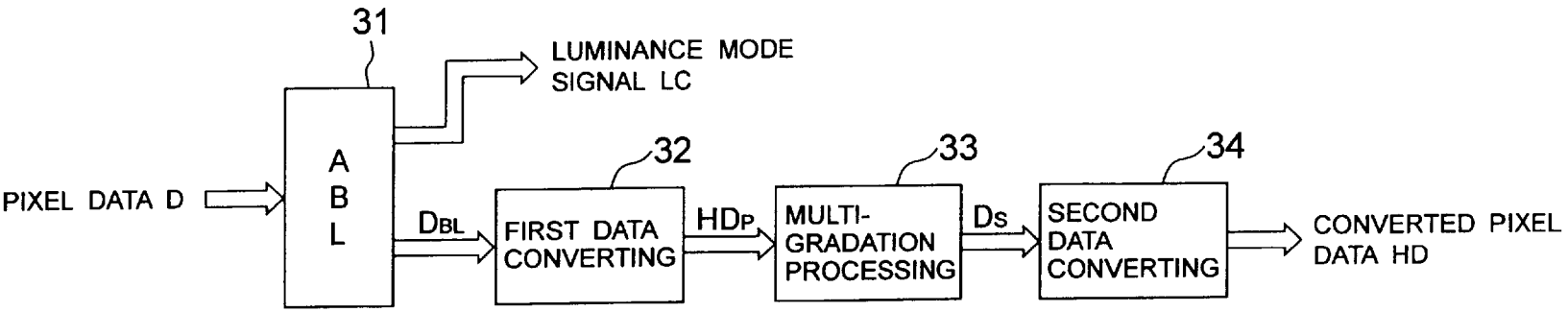
FIG. 6 is a diagram showing an internal arrangement of a data converting circuit.

FIG. 6 is a view showing an internal arrangement of the data converting circuit 30. As shown in FIG. 6, the data converting circuit 30 is provided with an ABL (automatic brightness control) circuit 31, a first data converting circuit 32, a multi-gradation processing circuit 33, and a second data converting circuit 34.

The ABL circuit 31 adjusts the luminance level of the pixel data D for each pixel successively supplied from the analog-to-digital converter 1, so that average luminance of an image displayed on the screen of the PDP 10 will be within a predetermined luminance range, and supplies the resulting luminance adjusted pixel data $D_{BL}$ to the first data converting circuit 32.

The luminance level is adjusted prior to an inverse gamma correction by setting a non-linear ratio to the number of light emissions in the subfields as described above. Hence, the ABL circuit 31 is arranged so that it applies the inverse gamma correction to the pixel data (input pixel data) D, and automatically adjusts the luminance level of the pixel data D in response to the average luminance of the resulting inverse-gamma-converted pixel data. This luminance adjustment, as a result, prevents deterioration of a display quality.

Figure 7:
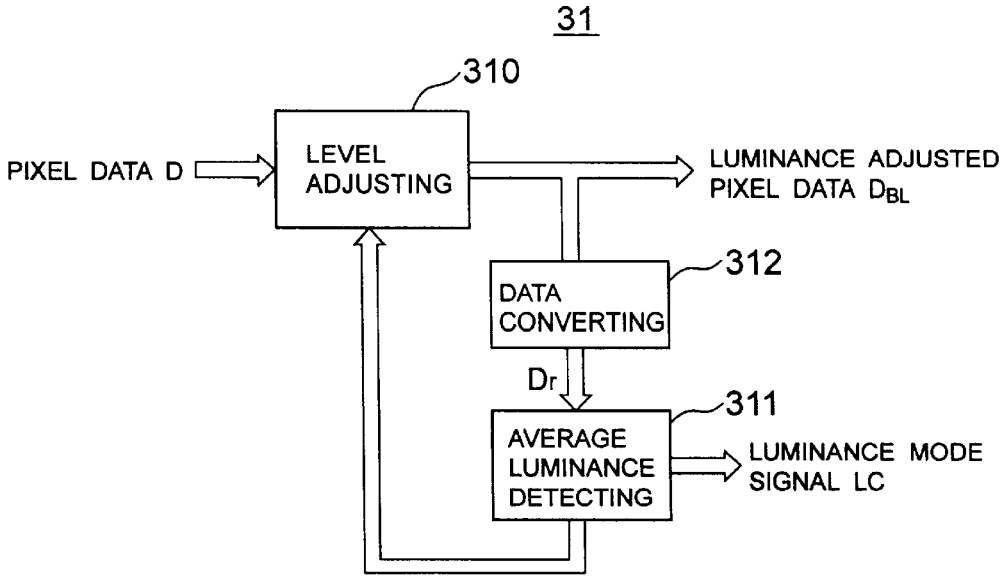
FIG. 7 is a diagram showing an internal arrangement of an ABL circuit.

FIG. 7 is a view showing an internal arrangement of the ABL circuit 31.

Figure 8:
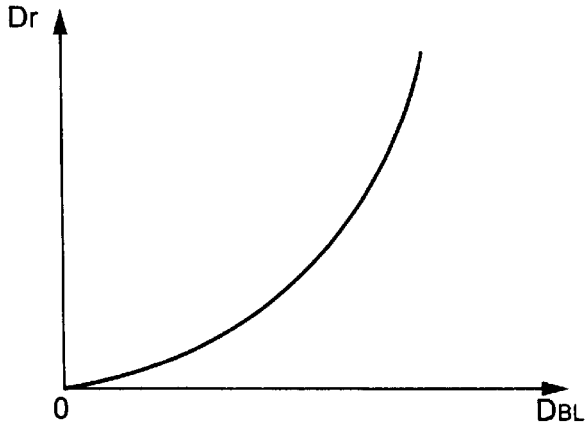
FIG. 8 is a diagram showing a converting characteristic in the data converting circuit.

Referring to FIG. 7, a level adjusting circuit 310 adjusts the level of the pixel data D in response to the average luminance found by an average luminance detecting circuit 311 described below, and outputs the resulting luminance adjusted pixel data $D_{BL}$. The data converting circuit 312 converts the luminance adjusted pixel data $D_{BL}$ into inverse-gamma-converted pixel data Dr with an inverse gamma characteristic ($Y=X^{2.2}$), which is a non-linear characteristic as shown in FIG. 8, and supplies the same to the average luminance detecting circuit 311. In other words, by applying the inverse gamma correction to the luminance adjusted pixel data $D_{BL}$ at the data converting circuit 312, gamma-correction-eliminated pixel data (inverse-gamma-converted pixel data Dr) corresponding to an original video signal is restored.

The average luminance detecting circuit 311 selects a luminance mode in which the PDP 10 is driven to emit light at luminance corresponding to the average luminance found as above from, for example, a first mode and a second mode as shown in FIG. 9 in order to specify the light emitting period (the number of light emissions) in each subfield, and supplies a luminance mode signal LC indicating the selected luminance mode to the driving control circuit 2. At this point, the driving control circuit 2 sets the period to sustain light emissions during the light emission sustaining step Ic in each of the subfields SF1 through SF14 shown in FIG. 5, that is, the number of sustain pulses applied during each light emission sustaining step Ic, in accordance with the ratio of the number of light emissions in each mode specified by the luminance mode signal LC as shown in FIG. 9. In other words, when the average luminance level of the input pixel data D is lower than a predetermined value, the first mode is set, and when the average luminance level is equal to or higher than the predetermined value, the mode is shifted to the second mode, in which the number of light emissions in each subfield is fewer than in the first mode, whereby the luminance is automatically limited.

Also, the average luminance detecting unit 311 finds average luminance of the inverse-gamma-converted pixel data Dr, and supplies the same to the level adjusting circuit 310.

Figure 10:
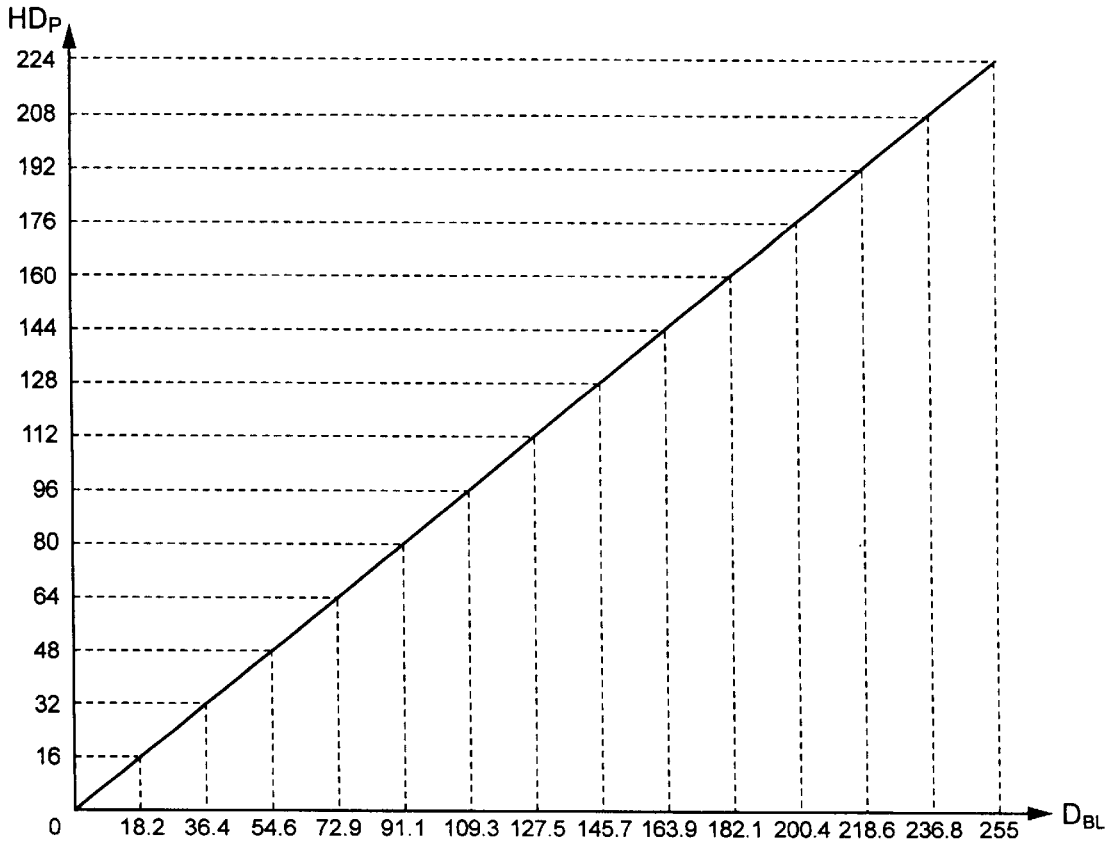
FIG. 10 is a diagram showing a converting characteristic in a first data converting circuit.

The first data converting circuit 32 of FIG. 6 converts the luminance adjusted pixel data $D_{BL}$ with a 256-step gradation (8-bit) to 14×16/255(224/255) levels of 8-bit (0 through 224) converted pixel data $HD_P$ based on the converting characteristic shown in FIG. 10, and supplies the same to the multi-gradation processing circuit 33. To be more specific, the 8-bit (0 through 255) luminance adjusted pixel data $D_{BL}$ is converted in accordance with a conversion table based on the converting characteristic. In other words, the converting characteristic is set depending on the number of bits of the input pixel data, the number of compressed bits by the multi-gradation, and the number of display luminance levels. In this manner, the first data converting circuit 32 is provided in the stage preceding the multi-gradation processing circuit 33 described below to apply data conversion corresponding to the number of display luminance levels and the number of compressed bits by the multi-gradation, and the luminance adjusted pixel data $D_{BL}$ is divided into a group of higher order bits (corresponding to multi-gradated pixel data) and a group of lower order bits (discarded data: error data) at a bit boundary, so that the multi-gradation processing is performed by the resulting signal. Consequently, it is possible to prevent an occurrence of luminance saturation caused by the multi-gradation processing and a generation of a flat portion in the display characteristic (that is, an occurrence of a level distortion) caused when no display luminance level is present at the bit boundary.

Herein, because the group of lower order bits is discarded, the number of the gradation levels is decreased. However, quasi-levels are obtained in the matching number with the decreased levels by an operation of the multi-gradation processing circuit 33.

Figure 11:
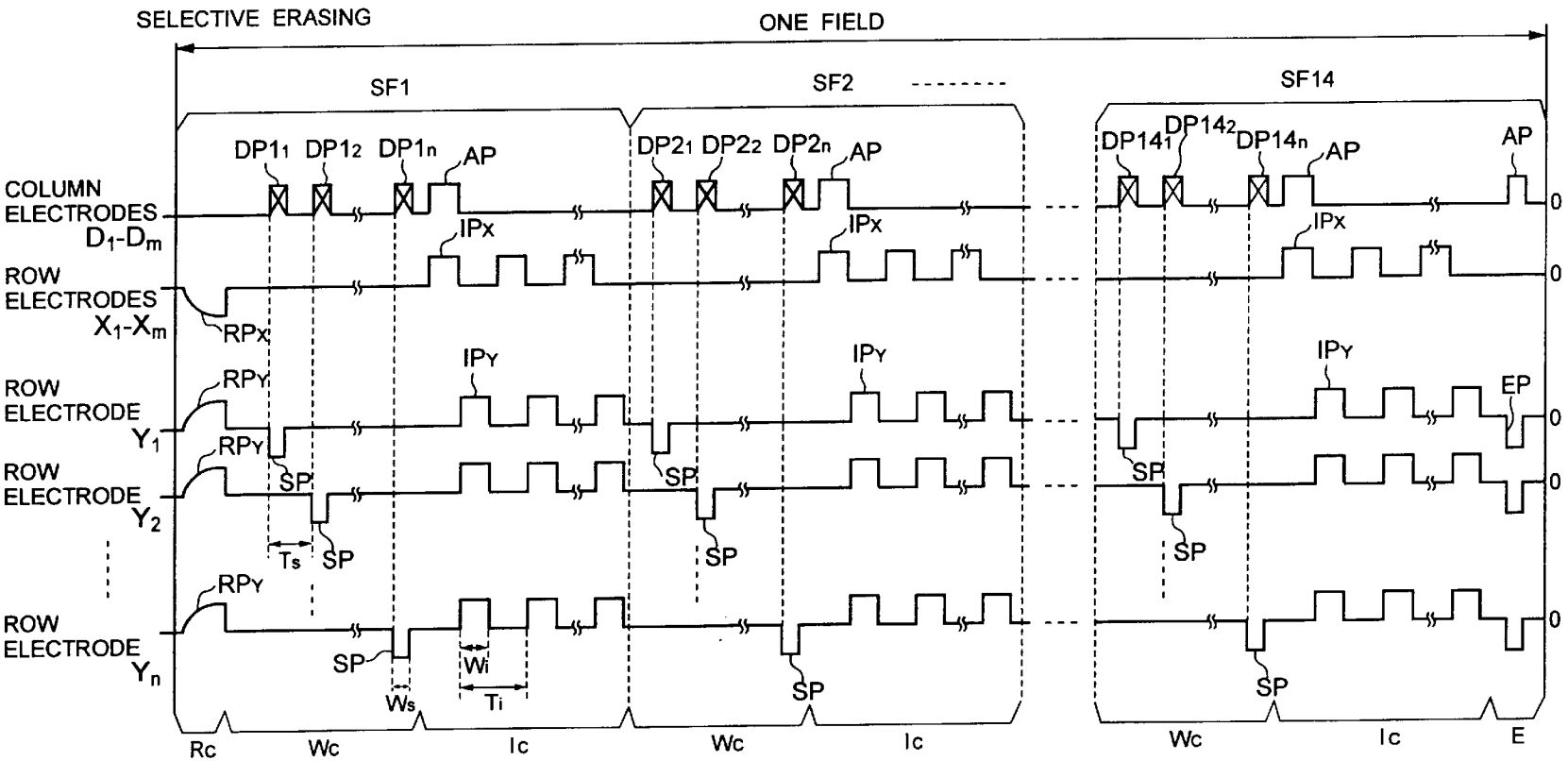
FIG. 11 is a diagram showing application timings of various kinds of driving pulses applied to the respective electrodes of the PDP.

FIG. 11 is a view showing application timings (within one field) of various kinds of driving pulses applied to the column electrode D and the row electrode X and Y of the PDP 10 from the address driver 6, the first sustaining driver 7, and the second sustaining driver 8 in response to various kinds of timing signals supplied from the driving control circuit 2.

Referring to FIG. 11, during the collective reset step Rc performed only in the subfield SF1, the first sustaining driver 7 and the second sustaining driver 8 initially apply a reset pulse $RP_x$ of a negative polarity and a reset pulse $RP_y$ of a positive polarity as shown in the drawing to the row electrodes $X_1$ through $X_n$ and $Y_1$ through $Y_n$ concurrently. When these reset pulses $RP_x$ and $RP_y$ are applied, a reset discharge takes place in all the discharge cells of the PDP 10, and predetermined wall charges are formed uniformly in each of the discharge cells. Consequently, all the discharge cells of the PDP 10 are initialized to be "light emitting cells" for the time being.

Then, during the pixel data writing step Wc in each subfield, the address driver 6 generates pixel data pulse groups $DB1_{11}$ through $DB1_{nm}$, . . . , $DB14_{11}$ through $DB14_{nm}$ having voltages corresponding to respective logical levels from the $DB1_{11}$ through $DB1_{nm}$, . . . , $DB14_{11}$ through $DB14_{nm}$ supplied from the memory 4 as described above. The address driver 6 allocates these pixel data pulse groups $DB1_{11}$ through $DB1_{nm}$, . . . , $DB14_{11}$ through $DB14_{nm}$ to the subfields SF1 through SF14, respectively, and successively applies one row of the pixel data pulse groups to the column electrodes $D_1$ through $D_m$ in each subfield row by row. For example, during the pixel data writing step Wc in the subfield SF1, the address driver 6 initially extracts data for the first row, that is, $DB1_{11}$ through $DB1_{1m}$ from the $DB1_{11}$ through $DB1_{nm}$, generates a pixel data pulse group $DP1_1$ composed of m pixel data pulses respectively corresponding to the logical levels of the $DB1_{11}$ through $DB1_{1m}$, and applies the same to the column electrodes $D_1$ through $D_m$. Then, the address driver 6 extracts $DB1_{21}$ through $DB1_{2m}$ for the second row from the $DB1_{11}$ through $DB1_{nm}$, generates a pixel data pulse group $DP1_2$ composed of m pixel data pulses respectively corresponding to the logical levels of the $DB1_{21}$ through $DB1_{2m}$, and applies the same to the column electrodes $D_1$ through $D_m$ concurrently. Thereafter, the address driver 6 successively applies one row of pixel data pulse groups $DP1_3$ through $DP1_n$ to the column electrodes $D_1$ through $D_m$ row by row during the pixel data writing step Wc in the subfield SF1 in the same manner. Herein, assume that, for example, the address driver 6 generates a pixel data pulse of a high voltage when the logical level of the DB1 is "1", and generates a pixel data pulse of a low voltage (0 V) when the logical level of the DB1 is "0". Also, during the pixel data writing step Wc in the subfield SF2, the address driver 6 initially extracts data for the first row, that is, $DB2_{11}$ through $DB2_{1m}$, from the $DB2_{11}$ through $DB2_{nm}$, generates a pixel data pulse group $DP2_1$ composed of m pixel data pulses respectively corresponding to the logical levels of the $DB2_{11}$ through $DB2_{1m}$, and applies the same to the column electrodes $D_1$ through $D_m$. Then, the address driver 6 extracts data for the second row, that is, $DB2_{21}$ through $DB2_{2m}$, from the $DB2_{11}$ through $DB2_{nm}$, generates a pixel data pulse group $DP2_2$ composed of m pixel data pulses respectively corresponding to the logical levels of the $DB2_{21}$ through $DB2_{2m}$, and applies the same to the column electrodes $D_1$ through $D_m$. Thereafter, the address driver 6 successively applies one row of pixel data pulse groups $DP2_3$ through $DP2_n$ to the column electrodes $D_1$ through $D_m$ row by row during the pixel data writing step Wc in the subfield SF2 in the same manner.

The address driver 6 generates pixel data pulse groups $DP3_1$ through $DP3_n$, . . . , $DP14_1$ through $DP14_n$ from $DB3_{11}$ through $DB3_{nm}$, . . . , $DB14_{11}$ through $DB14_{nm}$, respectively, during the pixel data writing step Wc in each of the subfields SF3 through SF14 in the same manner as above, and successively applies one row of the pixel data pulse groups to the column electrodes $D_1$ through $D_m$ row by row.

Herein, the second sustaining driver 8 generates a scanning pulse SP of a negative polarity as shown in FIG. 11 at the same timing as each application timing of the pixel data pulse group DP described above, and successively applies the same to the row electrodes $Y_1$ through $Y_n$. At this point, a discharge (selective erasing discharge) occurs only in the discharge cells at the intersection portions of the "rows" applied with the scanning pulse SP and the "columns" applied with the pixel data pulses of a high voltage, whereby the residual wall charges in these discharge cells are erased selectively. According to this selective erasing discharge, the discharge cells initialized to be in the "light emitting cell" condition in the collective reset step Rc are changed to be in a "non-luminous cell" condition. Incidentally, a discharge does not take place in the discharge cells formed on the "column" applied with the pixel data pulses of a low voltage, and these cells are sustained in the condition initialized in the collective reset step Rc, that is, the "light emitting cell" condition.

Then, during the light emission sustaining step Ic in each subfield, the first sustaining driver 7 and the second sustaining driver 8 apply sustain pulses $IP_x$ and $IP_y$ of a positive polarity alternately to the row electrodes $X_1$ through $X_n$ and $Y_1$ through $Y_n$, respectively. The number of times (period) that these sustain pulses $IP_x$ and $IP_y$ are applied during the light emission sustaining step Ic in each subfield is set for each subfield SF. For example, for the subfields SF1 through SF14 shown in FIG. 5, given "4" as the number of light emissions in the subfield SF1, then, the sustain pulses $IP_x$ and $IP_y$ are applied a specified number of times (period) during the light emission sustaining step Ic in each subfield as follows: SF1:4, SF2:12, SF3:20, SF4:32, SF5:40, SF6:52, SF7:64, SF8:76, SF9:88, SF10:100, SF11:112, SF12:128, SF13:140, and SF14:156. When the sustain pulses IP are applied, the discharge cells holding the residual wall charges since the pixel data writing step Wc, that is, the "light emitting cells", repeat a sustained discharge each time the sustain pulses $IP_x$ and $IP_y$ are applied, and sustain the discharge light emitting condition for the number of times (period) assigned to each subfield. Hence, during the light emission sustaining step Ic in the subfield SF1, a light emitting display is performed for a low luminance component in an input video signal. On the other hand, during the light emission sustaining step Ic in the subfield SF14, a light emitting display is performed for a high luminance component.

Also, as shown in FIG. 11, during the erasing step E performed only in the last subfield SF14, the address driver 6 generates an address pulse as an erasing pulse AP and applies the same to the respective column electrodes $D_1$ through $D_m$. The second sustaining driver 8 generates an erasing pulse EP concurrently with the application timing of the erasing pulse AP, and applies the same to the row electrodes $Y_1$ through $Y_n$. By applying these erasing pulses AP and EP concurrently, an erasing discharge takes place in all the discharge cells of the PDP 10, whereby the residual wall charges in all the discharge cells are lost. In other words, all the discharge cells of the PDP 10 become "non-luminous cells" by this erasing discharge.

FIG. 12 is a view showing all the patterns of the light emission driving performed based the light emission driving format shown in FIG. 11.

As shown in FIG. 12, the selective erasing discharge (indicated by a black circle) is applied to each discharge cell only in the pixel data writing step Wc in one of the subfields SF1 through SF14. In other words, the wall charges formed in all the discharge cells of the PDP 10 by performing the collective reset step Rc remain until the selective erasing discharge is performed, and promote a discharge light emission (indicated by a white circle) during the light emission sustaining step Ic in each subfield SF present in between. In other words, within one field, each discharge cell remains as a light emitting cell until the selective erasing discharge is applied, and it continues to emit light at a light emitting period ratio as shown in FIG. 5 during the light emission sustaining step Ic in each subfield present in between.

As shown in FIG. 12, the number of times that each discharge cell is changed from a light emitting cell to a non-luminous cell is one or less within one field period without fail. In other words, a light emission driving pattern such that a discharge cell set to be a non-luminous cell once is re-set to be a light emitting cell within in one field period is prohibited.

Hence, it is sufficient to perform the collective reset operation, which causes strong light emission regardless of the fact that it is not related to an image display, only once within one field period as shown in FIGS. 5 and 11, which makes it possible to control deterioration of contrast.

Also, because the selective erasing discharge is performed once at the maximum within one field period as indicated by a black circle of FIG. 12, it is possible to save power consumption.

Further, as shown in FIG. 12, there is no light emitting pattern such that a light emitting condition period is inverted to a non-luminance condition period within one field period, which makes it possible to control a pseudo-contour.

In addition, as to the scanning pulse SP, the pulse width thereof is set in such a manner that a larger pulse width is given to the scanning pulse SP in the subfield ahead in the sequential subfields SF1 through SF14. The reason way is as follows. When the sustained discharge light emissions are performed repetitively in a satisfactory manner in the light emitting condition (in the case of high luminance) in the subfield ahead of the subfield in which the selective erasing operation is to be performed, priming particles are present sufficiently in a discharge space, which ensures the occurrence of the selective erasing discharge. On the other hand, when no subfield in the light emitting condition is present ahead of the subfield in which the selective erasing operation is to be performed, or the subfields in the light emitting condition are too few (in the case of low luminance when the selective erasing discharge is performed in the subfield SF1 or SF2), the number of sustained discharge light emissions is so small that the priming particles present in the discharge space are insufficient. If the subfield for the selective erasing operation comes when only insufficient priming particles are present in the discharge space, there occurs a time delay until the selective erasing discharge actually takes place since the scanning pulse SP is applied, which makes the selective erasing discharge unstable. As a result, an erroneous discharge occurs during the sustained discharge period and a display quality deteriorates. Thus, by setting the pulse width of the scanning pulse SP lager in the subfield ahead in the sequential subfields SF1 through SF14, that is, by making the pulse width of the scanning pulse, SP in the first subfield SF1 (a first group of the subfield) larger than the pulse widths of the scanning pulses SPs in following subfield SF2 (a second group of the subfield), the subfield SF3 (a third group of the subfield), . . . , the subfield SF14 (a fourteenth group of the subfield) within one field period, the selective erasing discharge occurs in a reliable manner while the scanning pulse SP is being applied, thereby ensuring the stability of the selective erasing operation.

Also, the pulse width of the scanning pulse SP is set so that the pulse width in the first mode is larger than in the second mode for the same subfield. The reason why is as follows. As has been discussed, when either the first mode or second mode is selected depending on the average luminous level of the input pixel data D and the luminance is controlled by changing the number of light emissions (the number of sustain pulses) during the sustained discharge period in each of the same subfields, the mode is shifted to the second mode when the average luminous level of the input pixel data D becomes equal to or higher than the predetermined level. In the second mode, the number of sustained discharge light emissions is less than in the first mode in each of the same subfields. Hence, the excited priming particles in the discharge space by the sustained discharge light emissions are fewer than in the first mode, which makes the selective erasing discharge unstable during the pixel data writing step. As a result, an erroneous discharge occurs during the sustained discharge period and a display quality deteriorates. Hence, by setting the pulse width of the scanning pulse SP longer (that is, by increasing a scanning rate of the scanning pulses SPs) in the second mode than in the first mode in each subfield, the selective erasing discharge occurs in a reliable manner during the scanning pulse applying period, thereby ensuring the stability of the selective erasing operation.

The second data converting circuit 34 converts the multi-gradated pixel data $D_s$ into the converted pixel data (display pixel data) HD composed of the first through fourteenth bits respectively corresponding to the subfields SF1 through SF14 in accordance with the conversion table shown in FIG. 13. The multi-gradated pixel data $D_s$ is obtained by converting the 8-bit (256-gradation level) input pixel data D into 4-bit (15-gradation level) data in total by making the input pixel data D into 224/225 in accordance with the first data conversion, and compressing 2 bits of data in each by applying multi-gradation processing, such as the error diffusion processing and dither processing.

Herein, among the first through fourteenth bits in the converted pixel data HD, those having the logical level "1" indicate that the selective erasing discharge is performed during the pixel data writing step Wc in the subfields corresponding to these bits.

The converted pixel data HD corresponding to the respective discharge cells of the PDP 10 is supplied to the address driver 6 through the memory 4. At this point, the format of the converted pixel data HD corresponding to one discharge cell is one of 15 patterns shown in FIG. 13 without fail. The address driver 6 allocates the first through fourteenth bits in the converted pixel data HD to the subfields SF1 through SF4, respectively, and only when their bit logic shows the logical level "1", it generates a pixel data pulse of a high voltage during the pixel data writing step Wc in the corresponding subfields, and applies the same to the column electrode D of the PDP 10. Consequently, the selective erasing discharge takes place.

As has been described, the data converting circuit 30 converts the 8-bit pixel data D into the 14-bit converted pixel data HD, and 15-gradation level display as shown in FIG. 13 is achieved. However, because of the operation of the multi-gradation processing circuit 33 as described above, the gradation display has 256 levels visually.

As has been described, in the first place, an initializing discharge is allowed only in the first subfield within one field, so that all the discharge cells are initialized to be in the light emitting cell condition (when the selective erasing address method is adopted). Then, during the pixel data writing step in any one of the subfields, each discharge cell is set as either a non-luminous cell or a light emitting cell depending on the pixel data. Further, during the light emission sustaining step in each subfield, only the light emitting cells are allowed to emit light for a light emitting period corresponding to the weights assigned to the subfields. According to this driving method, in the case of the selective erasing address method, the subfields forming one field become the light emitting condition successively from the first subfield with an increase in luminance to be displayed, on the other hand, in the case of the selective erasing address method, the subfields forming one field become the light emitting condition successively from the last subfield with an increase in luminance to be displayed.

Figure 14:
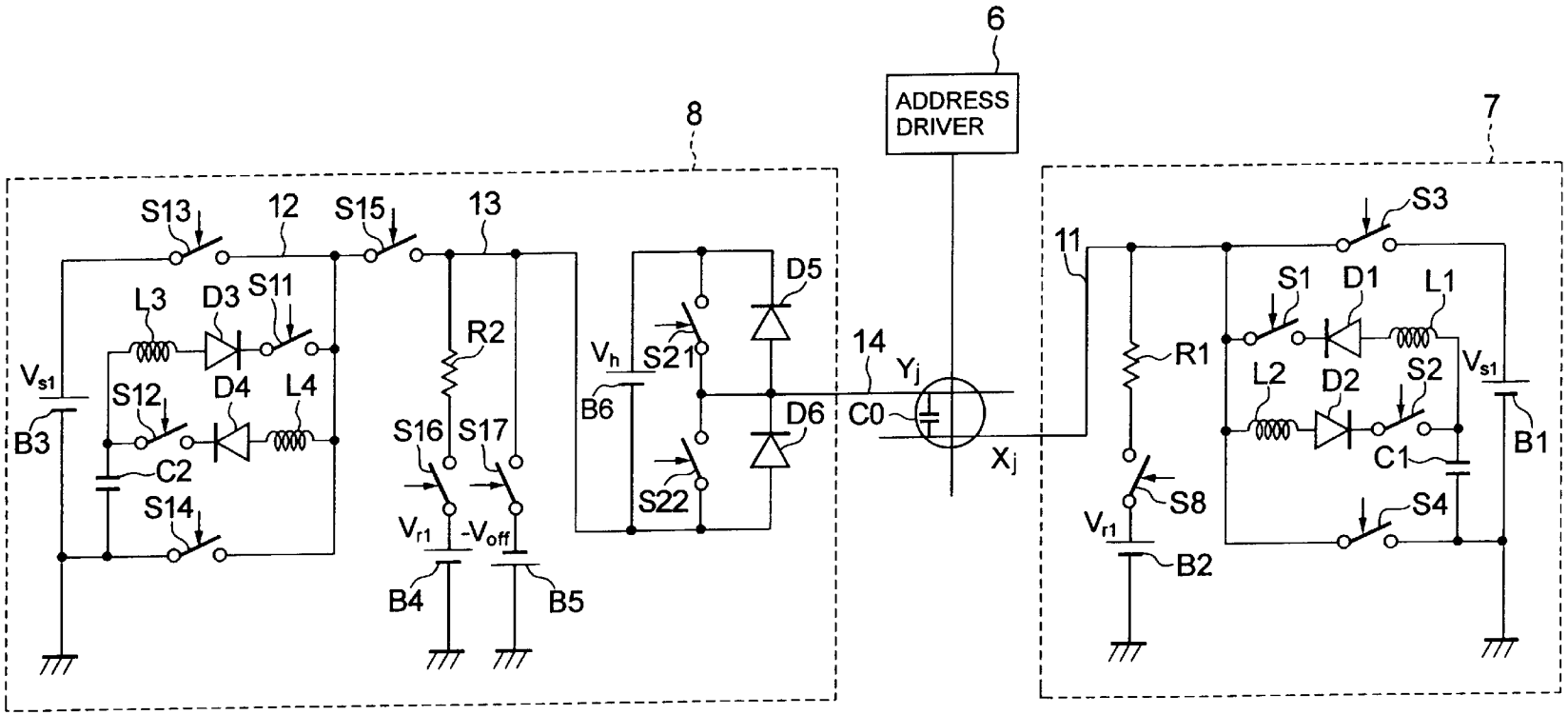
FIG. 14 is a circuit diagram showing a concrete arrangement of first and second sustaining drivers.

FIG. 14 shows a concrete arrangement of the first and second sustaining drivers 7 and 8 as to the electrode $X_j$ and the electrode $Y_j$. The electrode $X_j$ is the electrode in the j'th row among the electrodes $X_1$ through $X_n$, and the electrode $Y_j$ is the electrode in the j'th row among the electrodes $Y_1$ through $Y_n$. A space between the electrode $X_j$ and the electrode $Y_j$ functions as a capacitor C0.

The first sustaining driver 7 is provided with two power sources B1 and B2. The power source B1 outputs a voltage $V_{s1}$ (for example, 170 V), and the power source B2 outputs a voltage $V_{r1}$ (for example, 190 V). The positive terminal of the power source B1 is connected to a connection line 11 to the electrode $X_j$ through a switching element S3, and the negative terminal is grounded. Connected somewhere between the connection line 11 and the ground are, in addition to a switching element S4, a series circuit composed of a switching element S1, a diode D1, and a coil L1, and another series circuit composed of a coil L2, a diode D2, and a switching element S2 through a common capacitor C1 at the ground side. The diode D1 is connected so that its anode is at the capacitor C1 side and the diode D2 is connected so that its cathode is at the capacitor C1 side. Also, the positive terminal of the power source B2 is connected to the connection line 11 through a switching element S8 and a resistor R1, and the negative terminal of the power source B2 is grounded.

The second sustaining driver 8 is provided with four power sources B3 through B6. The power source B3 outputs a voltage $V_{s1}$ (for example, 170 V), the power source B4 outputs a voltage $V_{r1}$ (for example, 190 V), the power source B5 outputs a voltage $V_{off}$ (for example, 140 V), and the power source B6 outputs a voltage $V_h$ (for example, 160 V, $V_h > V_{off}$). The positive terminal of the power source B3 is connected to a connection line 12 to a switching element S15 through a switching element S13, and the negative terminal is grounded. Connected somewhere between the connection line 12 and the ground are, in addition to a switching element S14, a series circuit composed of a switching element S11, a diode D3, and a coil L3, and another series circuit composed of a coil L4, a diode D4 and a switching element S12 through a common capacitor C2 at the ground side. The diode D3 is connected so that its anode is at the capacitor C2 side and the diode D4 is connected so that its cathode is at the capacitor C2 side.

The connection line 12 is connected to a connection line 13 to the negative terminal of the power source B6 through the switching element S15. The positive terminal of each of the power sources B4 and B5 is grounded, and the negative terminal of the power source B4 is connected to the connection line 13 through a switching element S16 and a resistor R2. The negative terminal of the power source B5 is connected to the connection line 13 through a switching element S17.

The positive terminal of the power source B6 is connected to a connection line 14 to the electrode $Y_j$ through a switching element S21. The negative terminal of the power source B6 connected to the connection line 13 is connected to the connection line 14 through a switching element S22. A diode D5 is connected to the switching element S21 in parallel, and a diode D6 is connected to the switching element S22 in parallel. The diode D5 is connected so that its anode is at the connection line 14 side and the diode D6 is connected so that its cathode is at the connection line 14 side.

The ON/OFF operations of the switching elements S1 through S4, S8, S11 through S17, S21, and S22 are controlled by the driving control circuit 2. An arrow at each switching element in FIG. 14 indicates a control signal terminal from the control circuit 2.

Herein, in the second sustaining driver 8, the power source B3, the switching elements S11 through S15, the coils L3 and L4, the diodes D3 and D4, and the capacitor C2 form a sustaining driver unit; the power source B4, the resistor R2, and the switching element S16 form a reset driver unit; and the rest of the power sources B5 and B6, the switching elements S13, S17, S21, and S22, and the diodes D5 and D6 form a scanning driver unit.

Figure 15:
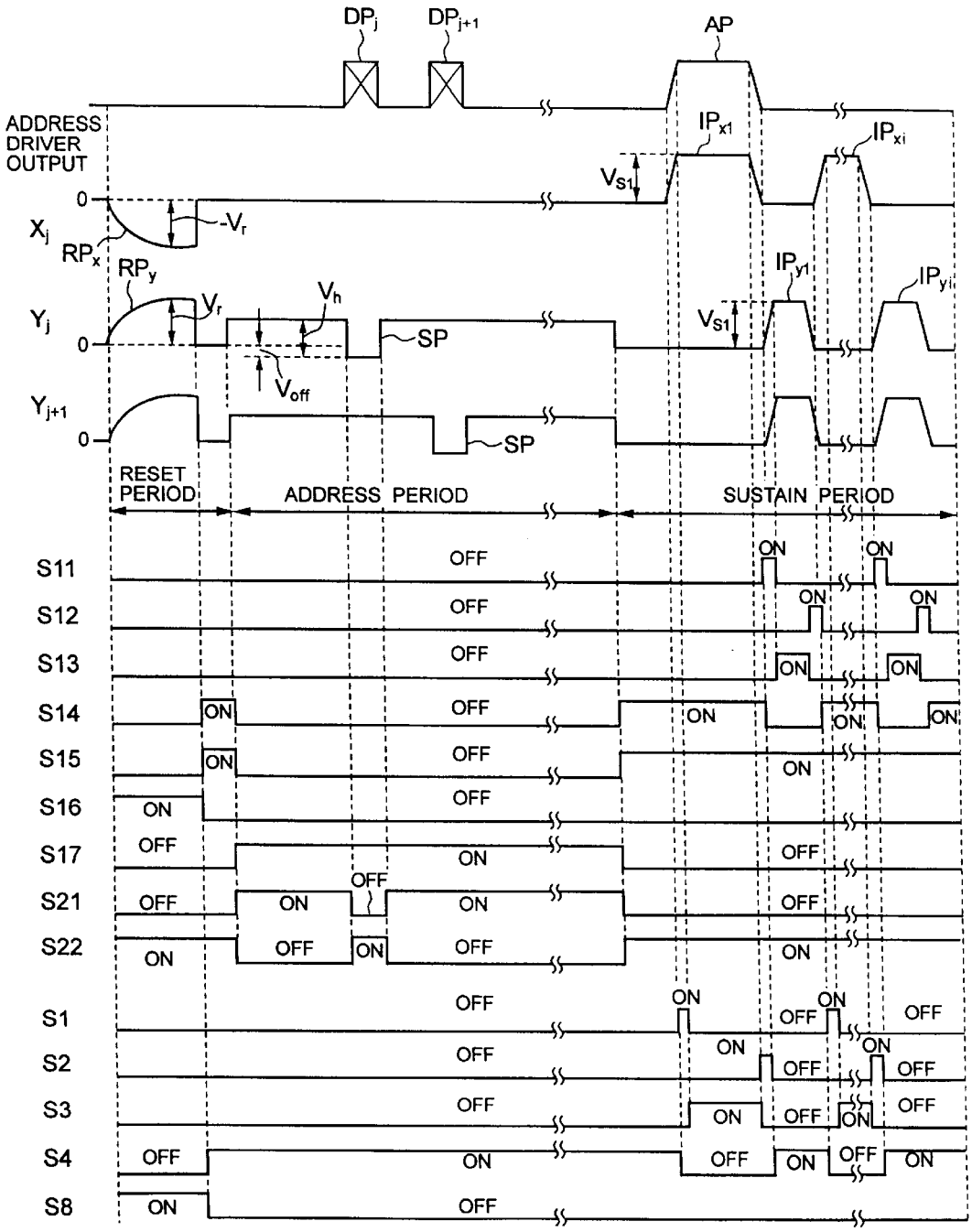
FIG. 15 is a time chart for each portion in the circuitry of FIG. 14 when an address pulse is applied.

Next, the following description will describe an operation of the above-arranged display apparatus with reference to the timing chart of FIG. 15. The timing chart of FIG. 15 shows only the first subfield. The operation of the display apparatus is composed of a reset period (reset step), an address period (pixel data writing step), and a sustain period (light emission sustaining step).

Initially, when the display apparatus enters the reset period, the switching element S8 in the first sustaining driver 7 is switched ON, and both the switching elements S16 and S22 in the second sustaining driver 8 are switched ON. At this point, all the other switching elements stay OFF. When the switching elements S16 and S22 are switched ON, a current flows to the electrode $Y_j$ from the positive terminal of the power source B4 through the switching element S16, the resistor R2, and the switching element S22, and when the switching element S8 is switched ON, a current flows into the negative terminal of the power source B2 from the electrode $X_j$ through the resistor R1 and the switching element S8. The potential of the electrode $X_j$ decreases gradually because of a time constant of the capacitor C0 and the resistor R1 and becomes a reset pulse $PR_x$, while the potential of the electrode $Y_j$ increases gradually because of a time constant of the capacitor C0 and the resistor R2 and becomes a reset pulse $PR_y$. The reset pulse $PR_x$ becomes a voltage $-V_{r1}$ in the end, while the reset pulse $PR_y$ becomes the voltage $V_{r1}$ in the end. The reset pulse $PR_x$ is applied to all the electrodes $X_1$ through $X_n$ concurrently, and the reset pulse $PR_y$ is generated for each of the electrodes $Y_1$ through $Y_n$ and applied to all the electrodes $Y_1$ through $Y_n$ concurrently.

By applying these reset pulses $RP_x$ and $RP_y$ concurrently, all the discharge cells of the PDP 10 are excited to discharge, whereby charged particles are generated. When the discharge ends, wall charges of a predetermined quantity are formed uniformly on the dielectric layers in all the discharge cells.

The switching elements S8 and S16 are switched OFF after the reset pulses $PR_x$ and $PR_y$ reach the saturation level and before the reset period ends. At this point, the switching elements S4, S14, and S15 are switched ON, and both the electrodes $X_j$ and $Y_j$ are grounded, whereupon the reset pulses $PR_x$ and $PR_y$ are lost.

Subsequently, when the address period starts, the switching elements S14, S15, and S22 are switched OFF and the switching element S17 is switched ON, and at the same time, the switching element S21 is switched ON. Consequently, the power source B6 and the power source B5 are connected in series, and $(V_h-V_{off})$ is given as the potential at the positive terminal of the power source B6. This positive potential is applied to the electrode $Y_j$ through the switching element S21.

During the address period, the address driver 6 converts the pixel data for each pixel based on a video signal to pixel data pulses $DP_1$ through $DP_n$ each having a voltage value corresponding to their respective logical levels, and successively applies one row of the data pulses to the column electrodes $D_1$ through $D_m$ row by row. Thus, as shown in FIG. 15, the pixel data pulses $DP_j$ and $DP_{j+1}$ are applied to the electrodes $Y_j$ and $Y_{j+1}$.

The second sustaining driver 8 successively applies the scanning pulse SP of a negative voltage to the row electrodes $Y_1$ through $Y_n$ in sync with the timing of each of the pixel data pulse groups $DP_1$ through $DP_n$.

The switching element S21 is switched OFF in sync with the application of the pixel data pulse $DP_j$ from the address driver 6, whereupon the switching element S22 is switched ON. Consequently, the negative potential $-V_{off}$ at the negative terminal of the power source B5 is applied to the electrode $Y_j$ through the switching element S17 and the switching element S22 as the scanning pulse SP. Subsequently, the switching element S21 is switched ON and the switching element S22 is switched OFF at the same time when the application of the pixel data pulse $DP_j$ from the address driver 6 is stopped. As a consequence, the potential $(V_h-V_{off})$ at the positive terminal of the power source B6 is applied to the electrode $Y_j$ through the switching element S21. Then, as shown in FIG. 15, the scanning pulse SP is applied to the electrode $Y_{j+1}$ in sync with the application of the pixel data pulse $DP_{J+1}$ from the address driver 6 in the same manner as the electrode $Y_j$.

Of all the discharge cells belonging to the row electrodes to which the scanning pulse SP is applied, a discharge occurs in those to which the pixel data pulse of a positive voltage is applied concurrently, so that these discharge cells lose most of the wall charges. On the other hand, a discharge does not occur in the discharge cells to which the scanning pulse SP is applied but the pixel data pulse of a positive voltage is not applied, so that these discharge cells hold the residual wall charges. Herein, the discharge cells holding the residual wall charges become the light emitting discharge cells, and the discharge cells having lost the wall charges become the non-luminous discharge cells.

When the address period shifts to the sustain period, the switching elements S17 and S21 are switched OFF, and in turn, the switching elements S14, S15 and S22 are switched ON. The switching element S4 stays ON.

During the sustain period, in the first sustaining driver 7, because the switching element S4 stays ON, the potential of the electrode $X_j$ is the ground potential at almost 0 V. Then, the switching element S4 is switched OFF, and the switching element S1 is switched ON, whereupon a current reaches the electrode $X_j$ through the coil L1, the diode D1, and the switching element S1 due to the charges accumulated in the capacitor C1, and the current flows into the capacitor C0, whereby the capacitor C0 is charged. At this point, as shown in FIG. 15, the potential of the electrode $X_j$ increases gradually because of a time constant of the coil L1 and the capacitor C0.

Then, the switching element S1 is switched OFF, and the switching element S3 is switched ON. Consequently, the potential $V_{s1}$ at the positive terminal of the power source B1 is applied to the electrode $X_j$. Subsequently, the switching element S3 is switched OFF, and the switching element S2 is switched ON, whereupon a current flows into the capacitor C1 from the electrode $X_j$ through the coil L2, the diode D2, and the switching element S2 due to the charges accumulated in the capacitor C0. At this point, as shown in FIG. 15, the potential of the electrode $X_j$ decreases gradually because of a time constant of the coil L2 and the capacitor C1. When the potential of the electrode $X_j$ decreases to almost 0 V, the switching element S2 is switched OFF, and the switching element S4 is switched ON.

According to these operations, the first sustaining driver 7 applies a sustain pulse $IP_{x1}$ (first sustain pulse) of a positive voltage as shown in FIG. 15 to the electrode $X_j$.

In the second sustaining driver 8, when the switching element S4 is switched ON, at which the sustain pulse $IP_{x1}$ is lost, the switching element S11 is switched ON and the switching element S14 is switched OFF concurrently. The potential of the electrode $Y_j$ is the ground potential at almost 0 V while the switching element S14 stays ON. However, when the switching element S14 is switched OFF and the switching element S11 is switched ON, a current reaches the electrode $Y_j$ through the coil L3, the diode D3, the switching element S11, the switching element S15, and the switching element S22 due to the charges accumulated in the capacitor C2, and the current flows into the capacitor C0, whereby the capacitor C0 is charged. At this point, as shown in FIG. 15, the potential of the electrode $Y_j$ increases gradually because of a time constant of the coil L3 and the capacitor C0.

Then, the switching element S11 is switched OFF and the switching element S13 is switched ON. Consequently, the potential $V_{s1}$ at the positive terminal of the power source B3 is applied to the electrode $Y_j$ through the switching element S13, the switching element S15, and the switching element S22. Subsequently, the switching element S13 is switched OFF and the switching element S12 is switched ON. Consequently, a current flows into the capacitor C2 from the electrode $Y_j$ through the switching element S22, the switching element S15, the coil L4, the diode D4, and the switching element S12 due to the charges accumulated in the capacitor C0. At this point, as shown in FIG. 15, the potential of the electrode $Y_j$ decreases gradually because of a time constant of the coil L4 and the capacitor C2. When the potential of the electrode $Y_j$ decreases to almost 0 V, the switching element S12 is switched OFF and the switching element S14 is switched ON.

According to these operations, the second sustaining driver 8 applies a sustain pulse $IP_{y1}$ of a positive voltage as shown in FIG. 15 to the electrode $Y_j$.

Herein, all the sustain pulses generated by the first sustaining driver 7 are referred to as $IP_x$, and all the sustain pulses generated by the second sustaining driver 8 are referred to as $IP_y$ in FIG. 11. However, in FIG. 15, individual sustain pulses $IP_x$ are referred to as $IP_{x1}$ through $IP_{xi}$, and individual sustain pulses $IP_y$ are referred to as $IP_{y1}$ through $IP_{yi}$. Herein, a small letter "i" indicates an integer value determined for each subfield.

During the remaining portion of the sustain period after the sustain pulse $IP_{y1}$ is applied to the electrode $Y_j$, the sustain pulses $IP_{x2}$ through $IP_{xi}$ and the sustain pulses $IP_{y2}$ through $IP_{yi}$ are generated alternately, and respectively applied to the electrode $X_i$ and the electrode $Y_i$ alternately. Hence, the light emitting discharge cells holding the residual wall charges repeat discharge light emissions, thereby sustaining the light emitting condition.

At the application timing of the respective sustain pulses $IP_{x1}$ through $IP_{xi}$ to the electrode $X_j$, these pulses are applied not only to the electrode $X_j$, but also to all the row electrodes $X_1$ through $X_n$ concurrently. Also, at the application timing of the respective the sustain pulses $IP_{y1}$ through $IP_{yi}$ to the electrode $Y_j$, these pulses are applied not only to the electrode $Y_j$, but also to all the row electrodes $Y_1$ through $Y_n$ concurrently.

Also, the first sustain pulse $IP_{x1}$ generated first during the sustain period in each subfield has a pulse width larger than those of the sustain pulses $IP_{x2}$ through $IP_{xi}$ and $IP_{y1}$ through $IP_{yi}$ generated later.

The driving control circuit 2 directs the address driver 6 to generate an address pulse at the same time the sustain pulse $IP_{x1}$ is generated during the sustain period. At the address pulse generation command form the control circuit 2, the address driver 6 applies an address pulse AP to the column electrodes $D_1$ through $D_m$ as shown in FIG. 15. The address pulse AP is of the same polarity as the sustain pulse $IP_{x1}$, and has substantially the same pulse width as the sustain pulse $IP_{x1}$.

As shown in FIG. 11, the address pulse AP is applied to the column electrodes $D_1$ through $D_m$ in each subfield.

By applying the address pulse AP to the $D_1$ through $D_m$ at the same time when the sustain pulse $IP_{x1}$ is applied to the row electrodes $X_1$ through $X_n$, a discharge hardly occurs between the row electrodes $X_1$ through $X_n$ and the column electrodes $D_1$ through $D_m$. Consequently, it is possible to prevent an occurrence of an erroneous discharge between the row electrodes $X_1$ through $X_n$ and the row electrodes $Y_1$ through $Y_n$ during the light emission sustain period in the discharge cells set as the non-luminous cells in the address period.

Figure 16:
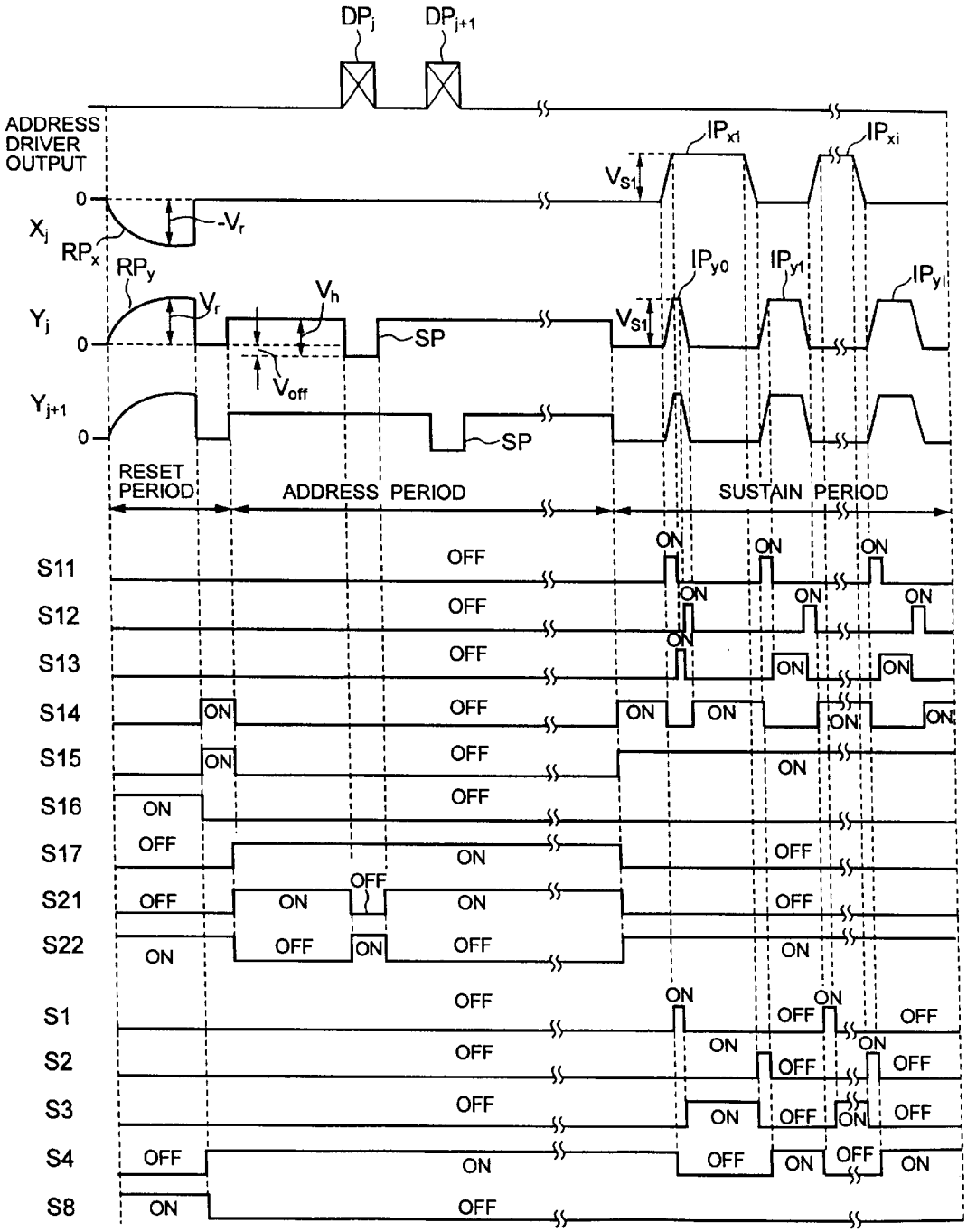
FIG. 16 is a time chart for each portion in the circuitry of FIG. 14 when a discharge control pulse is applied.

FIG. 16 is a view showing a PDP driving method for applying a discharge control pulse to the row electrodes $Y_1$ through $Y_n$ instead of applying the address pulse AP shown in FIG. 15.

According to the driving method of FIG. 16, the driving control circuit 2 directs the second sustaining driver 8 to generate a discharge control pulse at the same time when the sustain pulse $IP_{x1}$ is generated during the sustain period. The second sustaining driver 8 applies a discharge control pulse $IP_{y0}$ as shown in FIG. 16 to the row electrodes $Y_1$ through $Y_n$ (in FIG. 16, only the electrodes $Y_j$ and $Y_{j+1}$ are shown) concurrently in response to a discharge control pulse generation command from the control circuit 2. The discharge control pulse $IP_{y0}$ is of the same polarity as the sustain pulse $IP_{x1}$ but has an extremely small pulse width in comparison with the sustain pulse $IP_{x1}$.

In the second sustaining driver 8, when the discharge control pulse $IP_{y0}$ is generated, the same operation in generating the sustain pulse is performed. Initially, the switching element S14 is switched OFF, and at the same time, the switching element S11 is switched ON. Then, when the voltage level of the line 14 to the row electrode $Y_j$ increases to or almost to the voltage $V_{s1}$, the switching element S11 is switched OFF, and at the same time, the switching element S13 is switched ON for a short time, whereby the voltage $V_{s1}$ by the power source B3 is applied to the row electrode $Y_j$. When the switching element S13 is switched OFF, the switching element S12 is switched ON at the same time, whereupon the voltage level of the line 14 to the row electrode $Y_j$ starts to decrease gradually. When the voltage level decreases to almost 0 V, the switching element S12 is switched OFF, and the switching element S14 is switched ON at the same time. Consequently, the discharge control pulse $IP_{y0}$ is applied to the row electrode $Y_j$.

The other arrangements and the method are the same as shown in FIGS. 4 through 15, and the explanation is not repeated herein.

By applying the discharge control pulse $IP_{y0}$ to the row electrodes $Y_1$ through $Y_n$ at the same time when the application of the sustain pulse $IP_{x1}$ to the row electrodes $X_1$ through $X_n$ starts, substantially no potential difference is produced between the row electrodes $X_1$ through $X_n$ and the row electrodes $Y_1$ through $Y_n$. Hence, even when a discharge occurs between the row electrodes $X_1$ through $X_n$ and the column electrodes $D_1$ through $D_m$, it is possible to prevent an erroneous discharge between the row electrodes $X_1$ through $X_n$ and the row electrodes $Y_1$ through $Y_n$ during the light emission sustain period in the discharge cells set as the non-luminous cells in the address period.

If the discharge control pulse $IP_{y0}$ has a pulse width as wide as the pulse width of the sustain pulse $IP_{x1}$, even when the sustain pulse $IP_{x1}$ is applied to the column electrode of the discharge cell set as the light emitting cell in the address period, the sustained discharge light emission may not take place in the discharge cell. For this reason, the pulse width of the discharge control pulse $IP_{y0}$ is set extremely narrower than the pulse width of the sustain pulse $IP_{x1}$.

Figure 17:
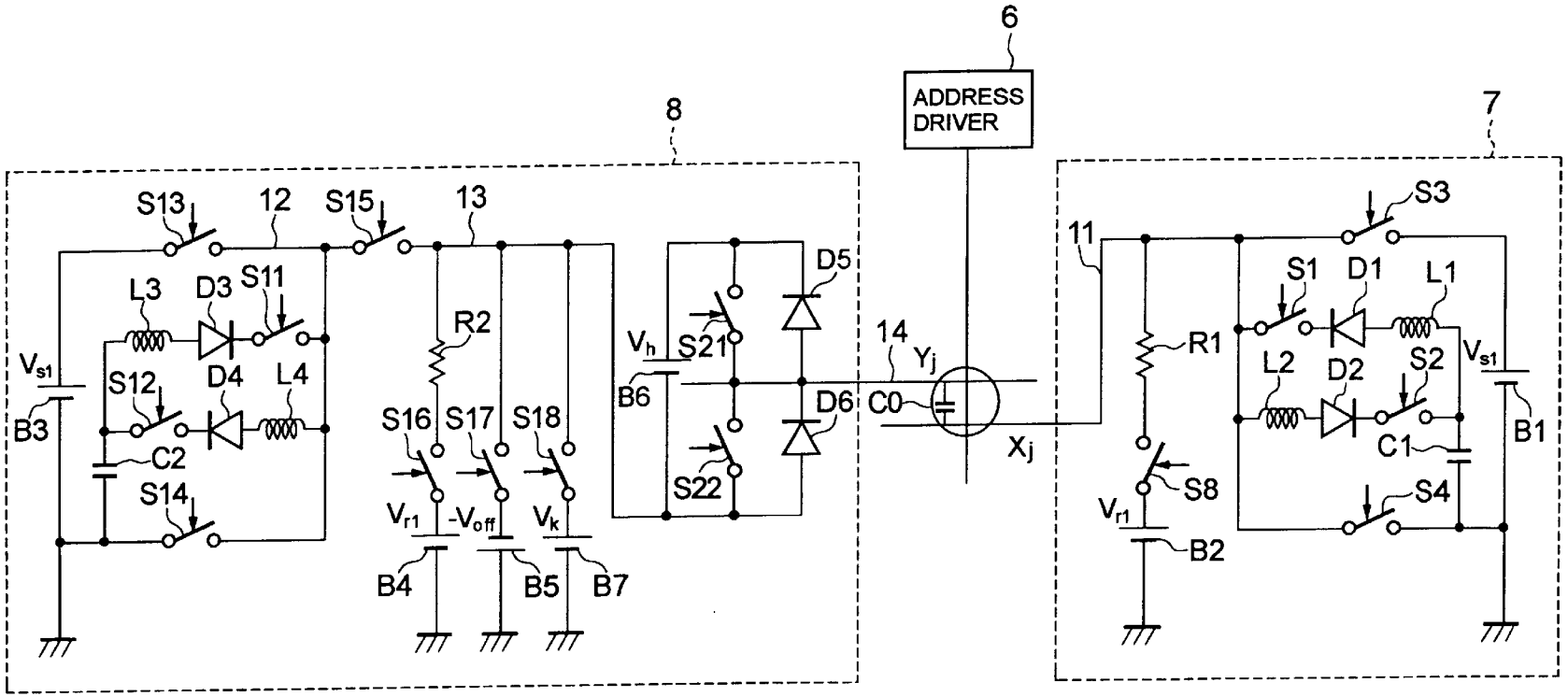
FIG. 17 is another circuit diagram showing a concrete arrangement of the first and second sustaining drivers.

FIG. 17 shows an arrangement of the second sustain period 8 specifically having the arrangement portion for generating the discharge control pulse shown in FIG. 16. The second sustaining driver 8 includes, in addition to the arrangement shown in FIG. 14, a switching element S18 and a power source B7. The power source B7 outputs a voltage $V_k$ that is set lower than then voltage $V_{s1}$. The positive terminal of the power source B7 is connected to the line 13 through the switching element S18, and the negative terminal is grounded. The rest of the arrangement is the same as shown in FIG. 14. The ON/OFF operations of the switching element S18 are controlled by the driving control circuit 2.

The driving control circuit 2 directs the second sustaining driver 8 to generate the discharge control pulse at the same time when the sustain pulse $IP_{x1}$ is generated during the sustain period. In response to the command, the switching element S18 is switched ON and the switching element S14 is switched OFF in the second sustaining driver 8.

Figure 18:
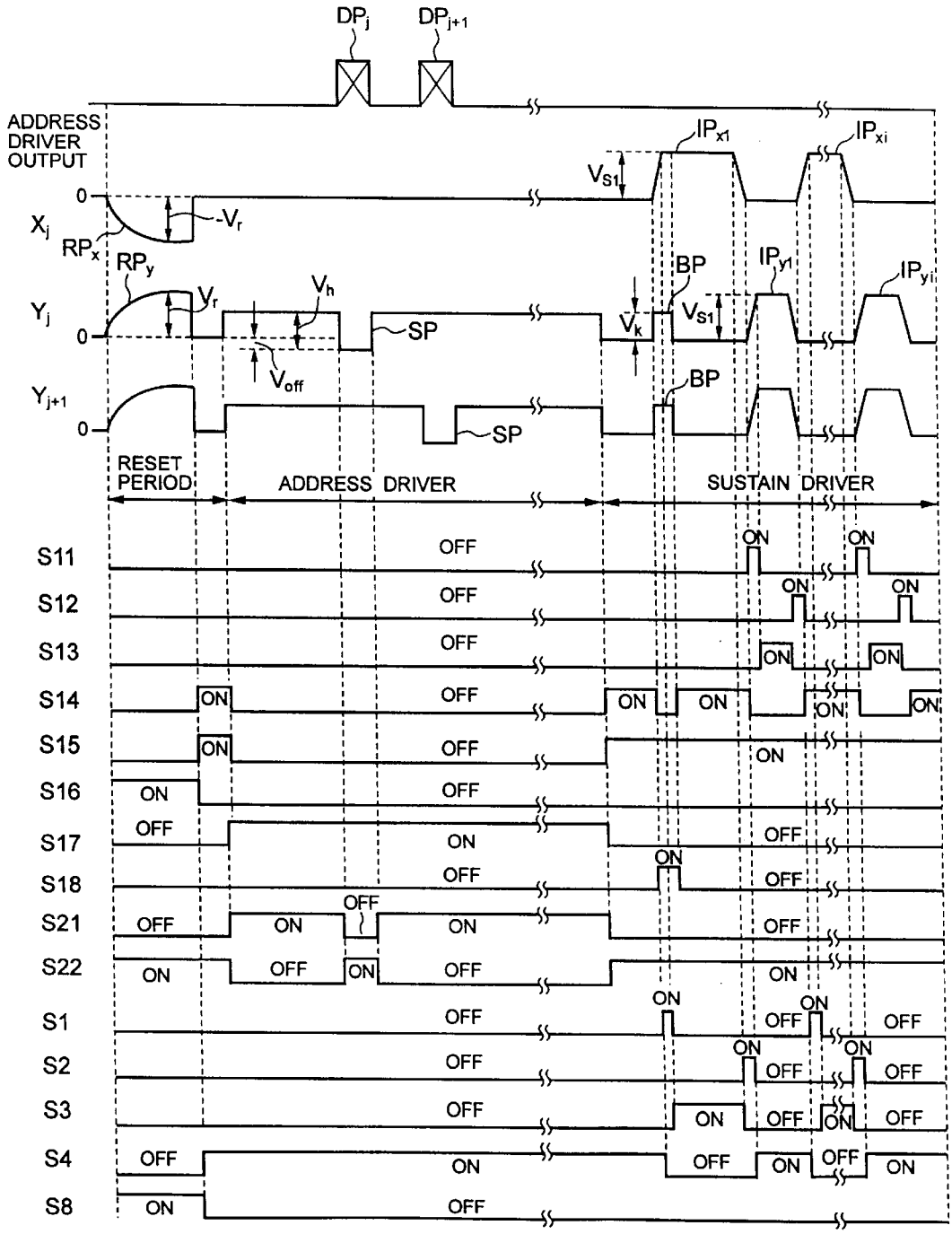
FIG. 18 is a time chart for each portion in the circuitry of FIG. 17 when another discharge control pulse is applied.

During the sustain period, as shown in FIG. 18, when the switching element S4 inverts from ON to OFF, the switching elements S1 and S18 are switched ON concurrently, and the switching element S14 is switched OFF. When the switching element S1 is switched ON, a current reaches the electrode $X_j$ through the coil L1, the diode D1, and the switching element S1 due to the charges accumulated in the capacitor C1, and the current flows into the capacitor C0. Thus, because the capacitor C0 is charged, the potential of the electrode $X_j$ increases gradually. The change in potential of the electrode $X_j$ is the same in the cases of FIGS. 15 and 16. Also, when the switching element S18 is switched ON, the positive potential $V_k$ at the positive terminal of the power source B7 is applied to the row electrode $Y_j$ through the switching element S22. Accordingly, the potential of the row electrode $Y_j$ immediately increases to the positive potential $V_k$ as shown in FIG. 18.

The ON-period of the switching element S18 is shorter than the time for the pulse width of the sustain pulse $IP_{x1}$. For example, as shown in FIG. 18, after the switching element S1 is switched OFF, and, in turn, the switching element S3 is switched ON, the switching element S18 is switched OFF, and at the same time, the switching element S14 is switched ON. When the switching element S18 is switched OFF and the switching element S14 is switched ON, the row electrode $Y_j$ is grounded through the switching elements S22, S15, and S14, and the potential decreases to almost 0 V. As a result of the switching operations of the switching elements S14 and S18 in the above manner, a discharge control pulse BP having the amplitude $V_k$ as shown in FIG. 18 is generated at the row electrode $Y_j$.

The generation and elimination of the sustain pulses $IP_{x1}$ through $IP_{xi}$ and $IP_{y1}$ through $IP_{xi}$ thereafter are the same as shown in FIGS. 15 and 16.

FIG. 18 shows the application of the discharge control pulse BP to only the row electrodes $Y_j$ and $Y_{j+1}$ among the row electrodes $Y_1$ through $Y_n$. However, in actual, the discharge control pulse BP is applied to all the row electrodes $Y_1$ through $Y_n$.

By applying the discharge control pulse BP to the row electrodes $Y_1$ through $Y_n$, substantially no potential difference is produced between the row electrodes $X_1$ through $X_n$ and the row electrodes $Y_1$ through $Y_n$. Hence, even when a discharge occurs between the row electrodes $X_1$ through $X_n$ and the column electrodes $D_1$ through $D_m$, it is possible to prevent an erroneous discharge between the row electrodes $X_1$ through $X_n$ and the row electrodes $Y_1$ through $Y_n$ during the light emission sustain period in the discharge cells set as the non-luminous cells in the address period.

Figure 19:
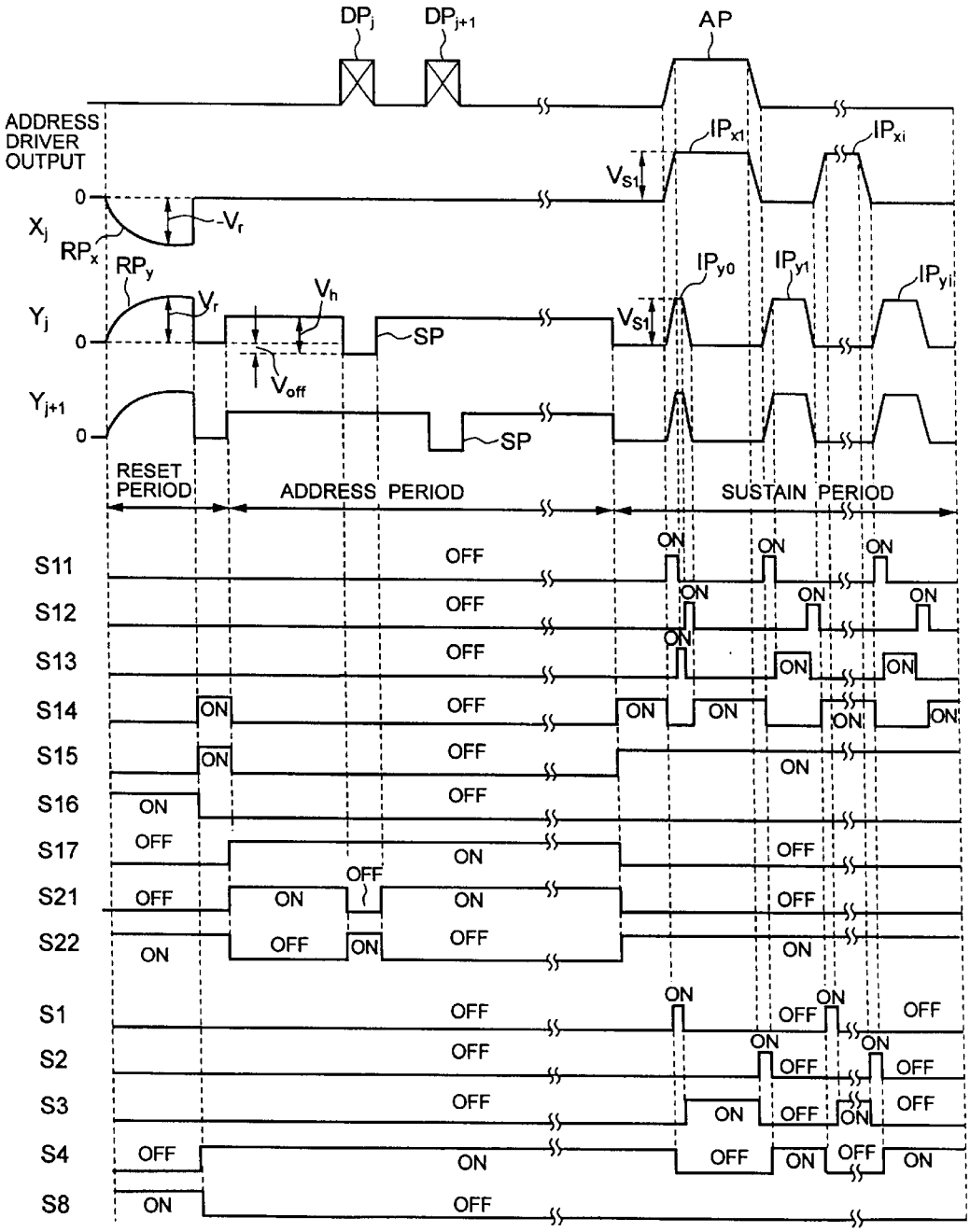
FIG. 19 is a time chart for each portion in the circuitry of FIG. 14 when an address pulse and a discharge control pulse are applied.

The address pulse AP shown in FIG. 15 and the discharge control pulse $IP_{y0}$ or BP shown in FIG. 16 or 18 may be used together. For example, as shown in FIG. 19, the address driver 6 applies the address pulse AP to the column electrodes $D_1$ through $D_m$ and the second sustaining driver 8 applies the discharge control pulse $IP_{y0}$ to the row electrodes $Y_1$ through $Y_n$ at the same time when the sustain pulse $IP_{x1}$ is generated.

Figure 1:
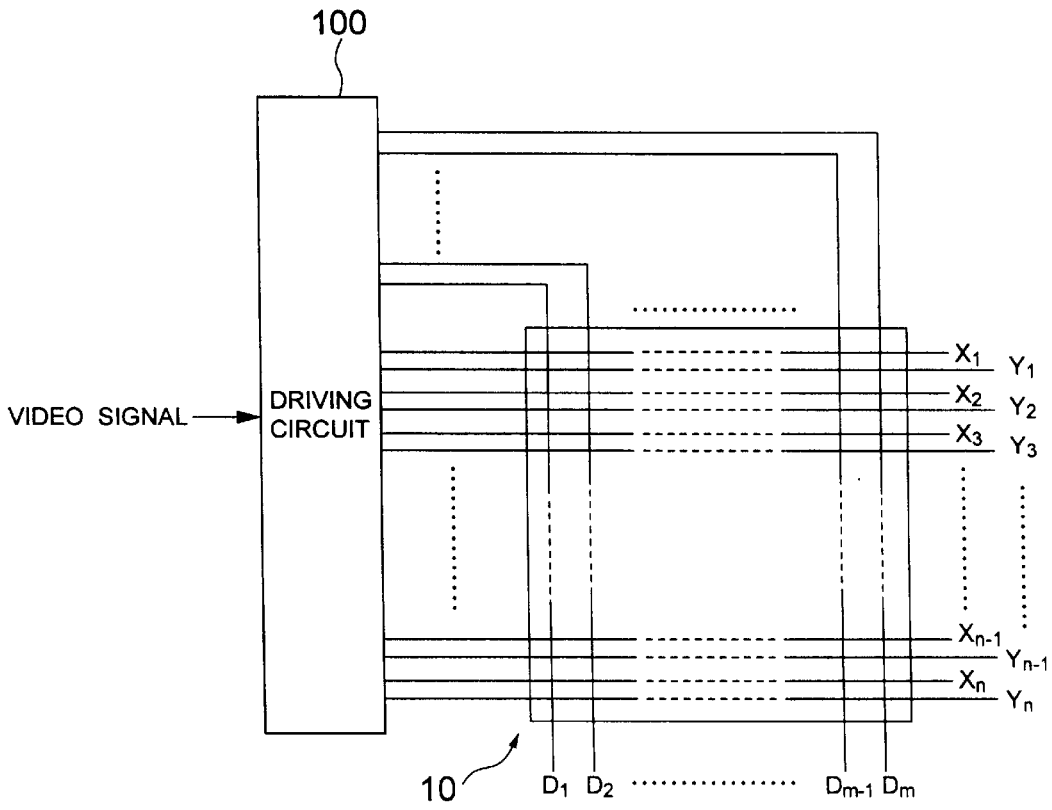
FIG. 1 is a diagram schematically showing an arrangement of a display apparatus using the conventional PDP driving method.
Figure 2:
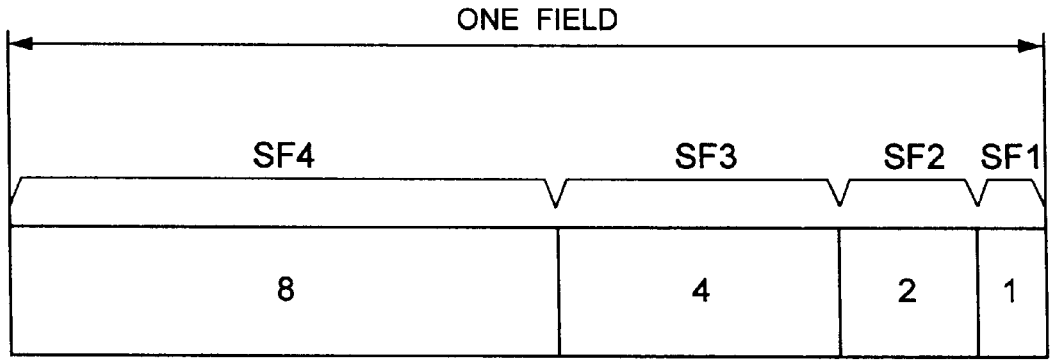
FIG. 2 is a diagram showing a light emission driving format of the apparatus of FIG. 1.
Figure 3:
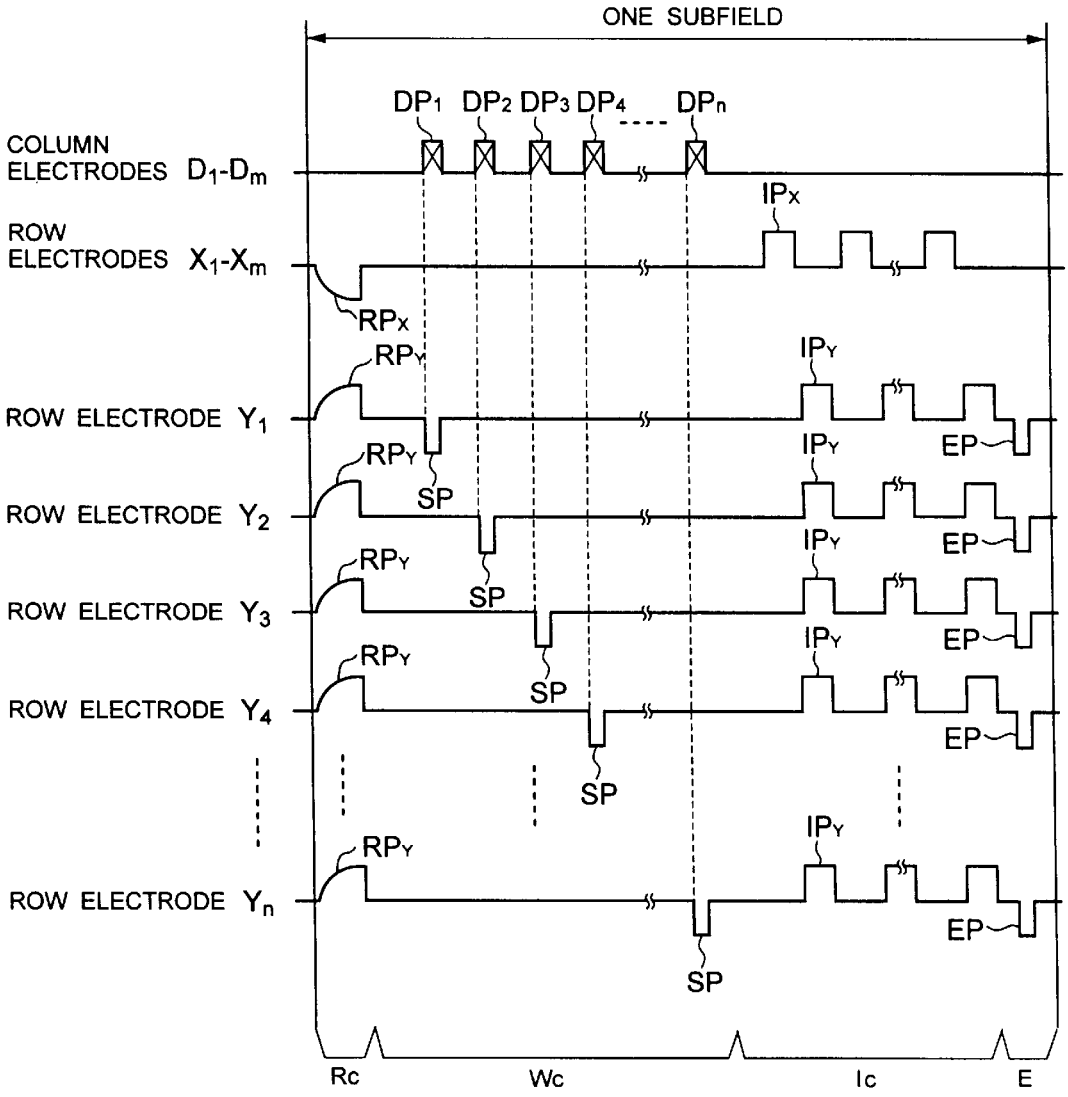
FIG. 3 is a diagram showing application timings of various kinds of driving pulses applied to the respective electrodes of a PDP in the apparatus of FIG. 1.

Also, each of the above embodiments shows a case where the present invention is applied to the 1-reset-1-selective erasing address method. It should be appreciated, however, that the present invention is not limited to the foregoing. For example, the present invention is applicable to a gray scale display for displaying $2^N$ levels using N subfields in the conventional manner as shown in FIGS. 2 and 3. Also, the present invention is applicable to the selective writing address method for forming the wall charges in each discharge cell selectively in response to the pixel data pulse during the pixel data writing step.

As has been described, according to the present invention, it is possible to display a high-quality image by preventing an erroneous discharge light emission between the row electrodes during the light emission sustaining step.

This application is based on a Japanese Patent Application No. 2001-194799 which is hereby incorporated by reference.

What is claimed is:

1. A method for driving a plasma display panel including a plurality of row electrode pairs each of which has a capacitive load between the row electrodes of each pair and a plurality of column electrodes arranged to intersect with said row electrode pairs to form a discharge cell at each intersection portion, to display an image with gradations in accordance with a video signal, the method comprising the steps of:

forming a plurality of subfields into which a display period of one field in said video signal are divided, in each of said subfields, executing:

a pixel data writing step for generating pixel data indicating one of a light emitting cell and a non-light emitting cell for each discharge cell of said plasma display panel in accordance with said video signal, for applying a scanning pulse to one row electrode in each pair of said plurality of row electrode pairs successively and for applying a pixel data pulse corresponding to said pixel data to each of said plurality of column electrodes in synchronism with said scanning pulse, so that each discharge cell becomes one of a light emitting cell condition and a non-light emitting cell condition corresponding to said pixel data; and a light emission sustaining step for applying a sustain pulse to row electrodes in each pair of said plurality of row electrode pairs alternately by the number of times corresponding to weights assigned to each of said subfields, so that only discharge cells which have become the light emitting cell condition in said pixel data writing step sustain discharge, and applying an address pulse to each of said column electrodes concurrently with a first sustain pulses which is a sustain pulse first applied during said light emission sustaining step, said address pulse and the first sustain pulse having a same polarity.

2. A driving method according to claim 1, wherein the pulse width of said first sustain pulse is larger than a pulse width of each sustain pulse applied after said first sustain pulse within one subfield.

3. A driving method according to claim 1, wherein:

said first sustain pulse is applied to the other row electrode in each pair of said plurality of row electrode pairs; and a discharge control pulse, having the same polarity as said first sustain pulse and a pulse width narrower than a pulse width of said first sustain pulse, is applied to one row electrode in each pair of said plurality of row electrode pairs concurrently with said first sustain pulse.

4. A driving method according to claim 3, wherein a voltage value of said discharge control pulse is smaller than voltage values of said sustain pulses.

5. A method for driving a plasma display panel including a plurality of row electrode pairs each of which has a capacitive load between the row electrodes of each pair and a plurality of column electrodes arranged to intersect with said row electrode pairs to form a discharge cell at each intersection portion, to display an image with gradations in accordance with a video signal, the method comprising the steps of:

forming a plurality of subfields into which a display period of one field in said video signal are divided, in each of said subfields, executing:

a pixel data writing step for generating pixel data indicating one of a light emitting cell and a non-light emitting cell for each discharge cell of said plasma display panel in accordance with said video signal, for applying a scanning pulse to one row electrode in each pair of said plurality of row electrode pairs successively and for applying a pixel data pulse corresponding to said pixel data to each of said plurality of column electrodes in synchronism with said scanning pulse, so that each discharge cell becomes one of a light emitting cell condition and a non-light emitting cell condition corresponding to said pixel data; and a light emission sustaining step for applying a sustain pulse to row electrodes in each pair of said plurality of row electrode pairs alternately by the number of times corresponding to weights assigned to each of said subfields, so that only discharge cells which have become the light emitting cell condition in said pixel data writing step sustain discharge, and applying a discharge control pulse to one row electrode in each pair of said plurality of row electrode pairs concurrently with a first sustain pulse, which is a sustain pulse applied first to the other row electrode in each pair of said plurality of row electrode pairs during said light emission sustaining step, said discharge control pulse having a same polarity as said first sustain pulse and having a pulse width narrower than the pulse width of said first sustain pulse.

6. A driving method according to claim 5, wherein a voltage value of said discharge control pulse is smaller than voltage values of said sustain pulses.

* * * * *